US009060919B2

(12) United States Patent
Babineau

(10) Patent No.: US 9,060,919 B2
(45) Date of Patent: Jun. 23, 2015

(54) CHILD-PROOF AND TAMPER-EVIDENT MEDICATION DISPENSERS

(71) Applicant: Thomas Babineau, Blaine, MN (US)

(72) Inventor: Thomas Babineau, Blaine, MN (US)

(73) Assignee: SPECIALIZED RX PRODUCTS L. L. C., Blaine, MN (US)

( * ) Notice: Subject to any disclaimer, the term of this patent is extended or adjusted under 35 U.S.C. 154(b) by 0 days.

(21) Appl. No.: 14/050,713

(22) Filed: Oct. 10, 2013

(65) Prior Publication Data

US 2014/0097113 A1 Apr. 10, 2014

Related U.S. Application Data

(60) Provisional application No. 61/711,963, filed on Oct. 10, 2012.

(51) Int. Cl.

| | |
|---|---|
| ***B65D 83/04*** | (2006.01) |
| ***A61J 1/03*** | (2006.01) |
| ***A61J 7/00*** | (2006.01) |

(52) U.S. Cl.

CPC ..... *A61J 1/03* (2013.01); *Y10T 29/49826* (2015.01); *A61J 7/0084* (2013.01); *B65D 83/0445* (2013.01); *B65D 2215/02* (2013.01)

(58) Field of Classification Search

USPC ..... 206/1.5, 528, 534, 534.1, 538

See application file for complete search history.

(56) References Cited

U.S. PATENT DOCUMENTS

| | | | | |
|---|---|---|---|---|
| 1,450,674 | A * | 4/1923 | Marston | 220/8 |
| 4,154,365 | A | 5/1979 | Lorea | |
| 4,347,930 | A * | 9/1982 | Herrin | 220/475 |
| 4,561,544 | A * | 12/1985 | Reeve | 206/540 |
| 4,887,790 | A | 12/1989 | Wilkinson et al. | |
| 5,348,180 | A * | 9/1994 | Shepard | 220/214 |
| 5,897,025 | A | 4/1999 | Flewitt et al. | |
| 7,708,142 | B2 | 5/2010 | Ehrlund | |
| 7,946,450 | B2 | 5/2011 | Gelardi et al. | |
| 8,033,425 | B2 | 10/2011 | Gelardi | |
| 8,066,123 | B2 | 11/2011 | Gelardi | |
| 8,087,540 | B2 | 1/2012 | Bailey et al. | |
| 8,096,411 | B2 | 1/2012 | Bailey et al. | |
| 8,123,037 | B2 | 2/2012 | Lee et al. | |
| 2009/0184022 | A1 * | 7/2009 | Coe et al. | 206/531 |
| 2009/0200332 | A1 | 8/2009 | Intini | |
| 2011/0204074 | A1 | 8/2011 | Gelardi et al. | |
| 2012/0012497 | A1 | 1/2012 | Weston et al. | |

* cited by examiner

*Primary Examiner* — Steven A. Reynolds
*Assistant Examiner* — Javier A Pagan
(74) *Attorney, Agent, or Firm* — Underwood & Associates, LLC

(57) ABSTRACT

Medication dispensers are provided that are both child-proof and tamper evident. In one embodiment, a child-proof and tamper-evident dispenser includes a tray member comprising a plurality of receptacles for receiving a pharmaceutical compound, a stop tab connected to a first peripheral edge by a neck member, and a tab member at a second peripheral edge that is opposite from the first peripheral edge. The dispenser further includes a bottom case body and a top case body configured to form an enclosure around the plurality of receptacles when brought into a substantially confronting relationship. Each of the bottom case body and the top case body include a sloped wall member having a shelf portion that surrounds the neck member when the enclosure is formed. A plurality of locking tabs engage a complimentary number of locking recesses configured to receive an end portion of the locking tabs to fix the bottom case body and the top case body in an enclosure configuration. The tray member includes a plurality of resiliently flexible locking arms that extend into a complimentary plurality of apertures within the case to secure the tray member within the enclosure.

20 Claims, 26 Drawing Sheets

CHILD-PROOF AND TAMPER-EVIDENT MEDICATION DISPENSERS

CROSS-REFERENCE TO RELATED APPLICATIONS

This application claims priority to and the benefit of U.S. Provisional Patent Application No. 61/711,963, filed on Oct. 10, 2012, the entire contents of which are incorporated by reference in their entirety as if fully set forth herein.

TECHNICAL FIELD

This disclosure relates to systems and methods for providing child-proof and tamper-evident medication dispensers. In particular, this disclosure relates to, among other aspects, a child-proof and tamper-evident troche dispenser.

BACKGROUND

Cautious parents often attempt to keep prescription and over-the-counter medications out of the reach of children, e.g., locked in a cabinet or placed in a suitable location to prevent access. Each year, however, children gain unauthorized access to medications, sometimes resulting in tragedy. Medications are sold in many forms, such as tablets, pills, liquids, gels, and powders. Existing child-proof or child-resistant mechanisms include specially-designed twist-off bottle caps for liquid medications and pill bottle tops requiring a combination of squeezing and turning to remove the cap, among others.

Federal anti-tamper laws were imposed after an incident in 1982 where potassium cyanide-laced analgesics led to the death of seven people in Chicago. Since then, some medication packages include one or more components that are configured to alert the consumer if the package has been tampered with. Examples of tamper-evident packaging include 'blister packs,' induction seals, and cap-rings, among others, which can indicate to the consumer that the package may have been compromised or contaminated.

SUMMARY

In one exemplary aspect, a child-proof and tamper-evident medication dispenser is disclosed. The dispenser includes a tray member including a plurality of receptacles for receiving a pharmaceutical compound, a stop tab connected to a first peripheral edge by a neck member, and a tab member at a second peripheral edge that is opposite from the first peripheral edge. The dispenser further includes a bottom case body and a top case body configured to form an enclosure around the plurality of receptacles when brought into a substantially confronting relationship. Each of the bottom case body and the top case body include a sloped wall member having a shelf portion that surrounds the neck member when the enclosure is formed. A plurality of locking tabs are configured to engage a complimentary number of locking recesses which is configured to receive an end portion of the locking tabs to fix the bottom case body and the top case body in an enclosure configuration. The tray member includes a plurality of resiliently flexible locking arms that extend into a complimentary plurality of apertures within the case to secure the tray member within the enclosure.

In one exemplary aspect, a medication dispenser is disclosed. The medication dispenser includes a tray member, including one or more receptacles for receiving the medication, a stop tab extending from a first peripheral edge of the tray member for providing tamper evidency of the dispenser, and a tab member connected to a second peripheral edge of the tray member that is opposite from the first peripheral edge. The medication dispenser further includes a bottom case body and a top case body that are cooperatively configured to lockingly enclose the one or more receptacles of the tray member when brought into a substantially confronting relationship, which defines an assembled dispenser configuration. Each of the bottom and top case bodies include a floor member, a side-wall member, and a front wall member wherein each of the side-wall member and the front wall member are orientated substantially perpendicular to the floor member. The front wall member of the bottom case body includes a shelf portion that cooperatively forms a stop-aperture for surrounding a portion of the stop tab substantially proximal to the first peripheral edge of the tray member when the top and the bottom case bodies are in the assembled dispenser configuration. When the top and the bottom case bodies are in the assembled dispenser configuration, the side-wall members cooperatively form opposite peripheral dispenser walls having at least one engagement aperture therein for receiving an engagement surface of a resiliently flexible locking arm disposed on the tray member, and a portion of a substantially rectangular aperture disposed opposite of the front wall member from which the tray member can be extracted from the dispenser.

In one embodiment, when the top and the bottom case bodies are in the assembled dispenser configuration, the side-wall members form opposite peripheral dispenser walls having oppositely disposed engagement apertures therein, each for receiving an engagement surface of oppositely-disposed, resiliently flexible locking arms on the tray member, respectively In one embodiment, the stop tab is configured to extend beyond the front wall member and provide evidence if the tray member is removed from the dispenser in the assembled dispenser configuration. In a related embodiment, the stop tab includes an aperture for receiving a removable locking mechanism therethrough in a stop tab portion that extends beyond the front wall member. In a further related embodiment, the locking mechanism is a wire, string, tie, zip-tie, or lock-tie.

In one embodiment, the stop-aperture has a width dimension, the stop tab has a width dimension greater than the stop-aperture width dimension, and the stop tab further includes a neck member connected to the first peripheral edge of the tray member, wherein a width dimension of the neck member is less than the width of the stop tab, and wherein the stop tab is capable of being removed from the tray member by breaking the neck member. In a related embodiment, the stop tab is configured to abut the front wall member about the stop-aperture if the tray member is shifted toward the substantially rectangular aperture while the neck member is unbroken.

In one embodiment, the stop tab is configured to be modified by a user to allow the tray member to be slidably removed from the dispenser in the assembled dispenser configuration.

In one embodiment, the resiliently flexible locking arm is normally biased so as to urge the engagement surface into the engagement aperture.

In one embodiment, the front wall member is C-shaped.

In one embodiment, at least one of the bottom case body or the top case body further includes a resiliently flexible arm that is shiftable to reversibly engage a portion of the resiliently flexible locking arm, to provide the capability of urging the engagement surface away from the engagement aperture.

In one embodiment, the side-wall members have a substantially corrugated cross-section including one or more recesses configured to receive the engagement surface of the resiliently flexible locking arm for incrementally slidingly removing the tray member from the dispenser in the assembled dispenser configuration. In a related embodiment, the side walls are configured to receive fingers of the human hand.

In one embodiment, the tray member can be reversibly slidingly disengaged from between the bottom case body and the top case body.

In one embodiment, the bottom case body includes a coupling member extending substantially orthogonal to the floor member, and the top case body includes a complimentary coupling recess for receiving the coupling member in a substantially locked configuration to join the bottom case body and the top case body in the assembled dispenser configuration. In a related embodiment, the coupling member is a configured as a lock tab.

In one embodiment, the one or more receptacles for receiving the medication are configured as a troche tray.

In one embodiment, tamper evidency of the dispenser is provided by a perceptible physical state of the stop tab, and child-proofing the medication within the tray member is provided by configuring the resiliently flexible locking arm to require a requisite amount of strength and dexterity greater than that normally possessed by an average child to disengage the engagement surface of the resiliently flexible locking arm from the engagement aperture when the dispenser is in the assembled dispenser configuration to remove the tray member from the dispenser.

In one embodiment, the tray member includes two of the flexible locking arms; wherein the wall members are configured to provide two engagement apertures, each for receiving one of the engagement surface from one of the flexible locking arms, respectively; and wherein the extraction of the tray member from the dispenser through the substantially rectangular aperture requires both of the engagement surfaces to be shifted out of each respective engagement aperture substantially simultaneously.

In one exemplary aspect, a method for providing a child-proof and tamper-evident medication dispenser is provided. The method includes providing a tray member, including one or more receptacles for receiving the medication, a stop tab extending from a first peripheral edge of the tray member for providing tamper evidency of the dispenser, and a tab member connected to a second peripheral edge of the tray member that is opposite from the first peripheral edge. The method further includes providing a bottom case body and a top case body that are configured to lockingly enclose the one or more receptacles of the tray member when brought into a substantially confronting relationship, which defines an assembled dispenser configuration, wherein each of the bottom and top case bodies comprise a floor member, a side-wall member, and a front wall member wherein each of the side-wall member and the front wall member are orientated substantially perpendicular to the floor member. In this method the front wall member of the bottom case body includes a shelf portion that cooperatively forms a stop-aperture for surrounding a portion of the stop tab substantially proximal to the first peripheral edge of the tray member when the top and the bottom case bodies are in the assembled dispenser configuration. In this method, when the top and the bottom case bodies are in the assembled dispenser configuration, the side-wall members cooperatively form opposite peripheral dispenser walls having at least one engagement aperture therein for receiving an engagement portion of a resiliently flexible locking arm disposed on the tray member, and a substantially rectangular aperture is formed opposite of the front wall member from which the tray member can be extracted from the dispenser. In this method, tamper evidency of the dispenser is provided by a perceptible physical state of the stop tab, and child-proofing medication within the tray member is provided by configuring the resiliently flexible locking arm to require an amount of requisite strength and dexterity greater than that possessed by an average child to disengage the engagement portion of the resiliently flexible locking arm from the engagement aperture when the dispenser is in the assembled dispenser configuration to remove the tray member from the dispenser.

The systems, methods, and articles disclosed herein provide certain distinct advantages over existing child-proof or tamper evident systems. For example, children may be better protected against unauthorized access to medications, which may reduce the likelihood of ingesting adult pharmaceuticals that lead to accidental overdose. In another example, certain packaging embodiments provide simultaneous child-proof safety features and concurrent indication of package tampering. In yet another example, certain packaging embodiments allow a pharmacist to easily load a troche tray with a desired medication; the tray can then be inserted and locked into a protective case that provides child-proof access and tamper evidence. Other advantages from the disclosed embodiments and variations thereof will be apparent to those skilled in the arts.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings in which like references indicate like elements, and in which:

FIG. 3C illustrates the tray member disposed within the bottom case body, according to one embodiment;

DETAILED DESCRIPTION OF ILLUSTRATIVE EMBODIMENTS

In general, packaging systems, methods, and articles are disclosed that simultaneously provide child-proof and tamper-evident properties. In general, the term "child-proof" as used herein carries its ordinary meaning in the art and relates to packages that are designed to thwart attempts by children in accessing contents within the package. While child-proof is a colloquial term used in the general field of pharmaceutical packaging, its context as an absolute is not intended herein and can also refer to child-resistant packaging. In general, the term "tamper-evident" also carries its ordinary meaning in the art and relates to packaging designed to indicate to a consumer that the purity of the package has been compromised in some way. Evidence of tampering may indicate that the contents of the package have been polluted or corrupted in a way that was not intended by the supplier of the package contents, e.g., a pharmaceutical supplier. In one exemplary aspect, troche dispensers are described that are simultaneously child-proof and tamper evident, which can provide improved health safety for consumers and their children.

Referring now to FIGS. 1-5, a child-proof and tamper-evident troche dispenser (hereinafter "dispenser") 100 is illustrated according to one embodiment.

Figure 4:
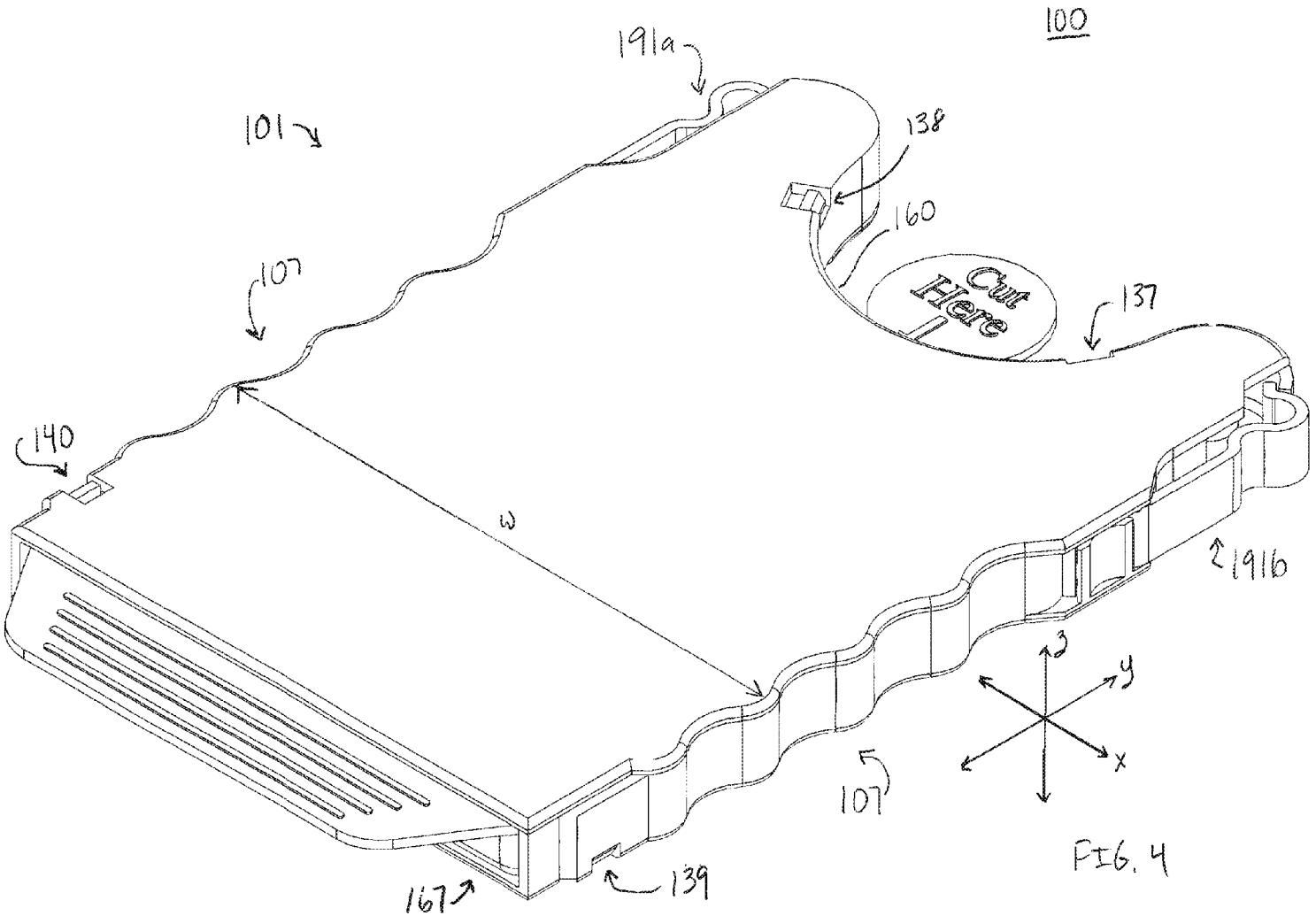
FIG. 4 illustrates the dispenser in an assembled configuration, according to one embodiment.

In this embodiment, the dispenser 100 includes a removable tray member 115 juxtaposed between a top case body 105 and a bottom case body 110. The tray member 115, top case body 105, and bottom case body 110 are capable of being reversibly locked in an assembled configuration, e.g., as illustrated in FIG. 4. Throughout this disclosure, the term "case" refers to the assembled configuration of the top case body, e.g., top case body 105 and the bottom case body, e.g., bottom case body 110 (and optionally the tray member 115) and is referred to by reference numeral 101. Throughout this disclosure, reference is made to a Cartesian coordinate system shown in FIG. 4. It will be understood, however, that the coordinate system of FIG. 4 and related description is not limiting and is provided solely for clarity of the instant drawings.

In this embodiment, the case 101 includes a plurality of recesses 107 formed in part from a series of C-shaped recesses 108*a* in a bottom case wall 103*a* and a complimentary series of C-shaped recesses 108*b* in a top case wall 103*b* when the bottom case body 105 and top case body 110 are brought into a substantially confronting relationship, e.g., as illustrated in FIG. 4.

In this embodiment, the top case body 105 includes a side wall 104*b* extending perpendicularly from the top case wall 103*b* that has a complimentary series of C-shaped recesses that match the shape of the series of C-shaped recesses 108*a* of the bottom case body 110. Similarly, the bottom case body 110 includes a side wall 104*a* extending perpendicularly from the bottom case wall 103*a* that has a complementary series of C-shaped recesses that match the shape of the series of C-shaped recesses 108*b* of the top case body 105.

In this embodiment, the recesses 107 of the assembled case 101 can be configured to receive fingers of a user as they grasp the dispenser 100 to provide dexterity while operating the dispenser 100 as described herein. The recesses 107 can also provide incremental latch positions that can be used when the tray member 115 is translated within the case 101 as described in greater detail below.

Figure 1:
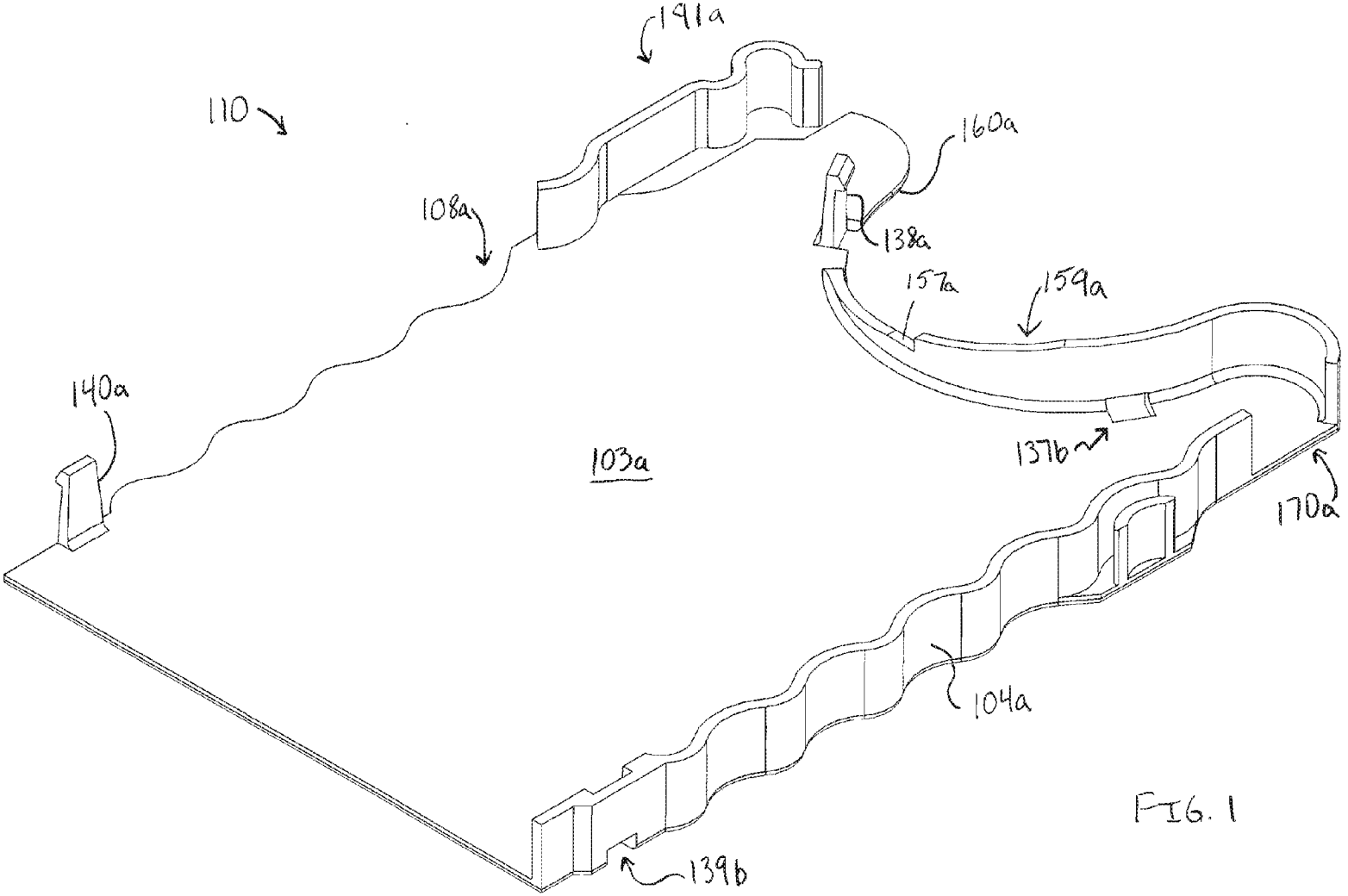
FIG. 1 illustrates a bottom case body of a dispenser, according to one embodiment.

In this embodiment, the top case body 105 can be reversibly locked to the bottom case body 110 in an assembled configuration (e.g., as illustrated in FIG. 4) using a plurality of locking tabs and complimentary locking apertures. For example, in this embodiment, FIG. 1 illustrates a locking tab 140*a* extending in the +z direction from the bottom case wall 103*a* of the bottom case body 110. A complimentary locking aperture 140*b* disposed in the top case body 105 is configured to receive and lockingly engage the locking tab 140*a* when the top case body 105 and bottom case body 110 are brought into a confronting relationship as illustrated, e.g., in FIG. 4. Similarly, in this embodiment, the top case body 105 includes a locking tab 139*a* extending in the −z direction from the top case wall 103*b* that is configured to lockingly engage locking aperture 139*b* disposed in the bottom case body 110. Throughout FIGS. 1-4, locking tab/recess systems are illustrated at reference numerals 137 (137*a*, 137*b*), 138 (138*a*, 138*b*), 139 (139*a*, 139*b*), and 140 (140*a*, 140*b*), where the reference numerals in parenthesis identify the locking tab and the locking aperture of each complimentary pair, respectively.

Figure 2:
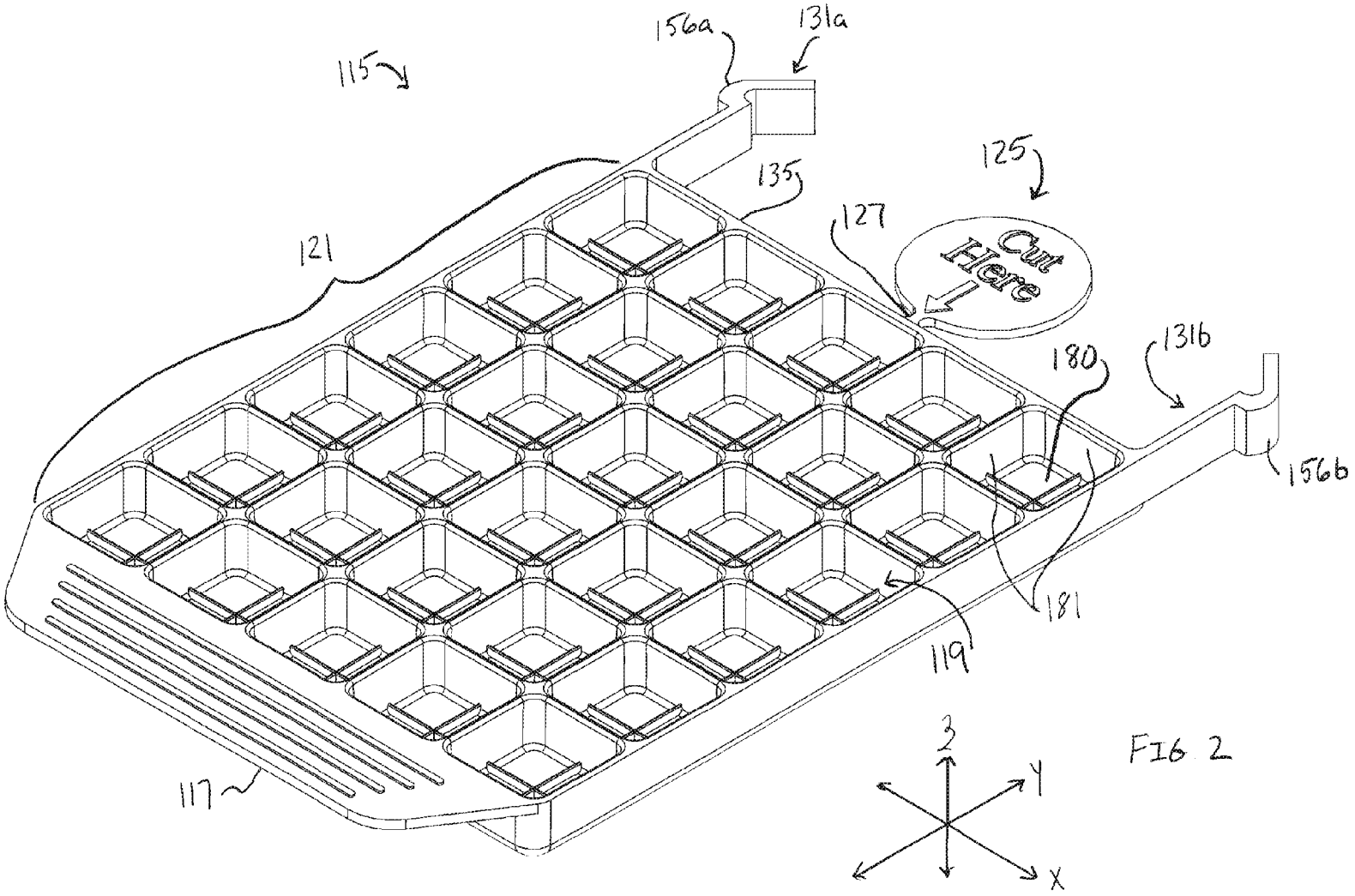
FIG. 2 illustrates a tray member of the dispenser, according to one embodiment.
Figure 3:
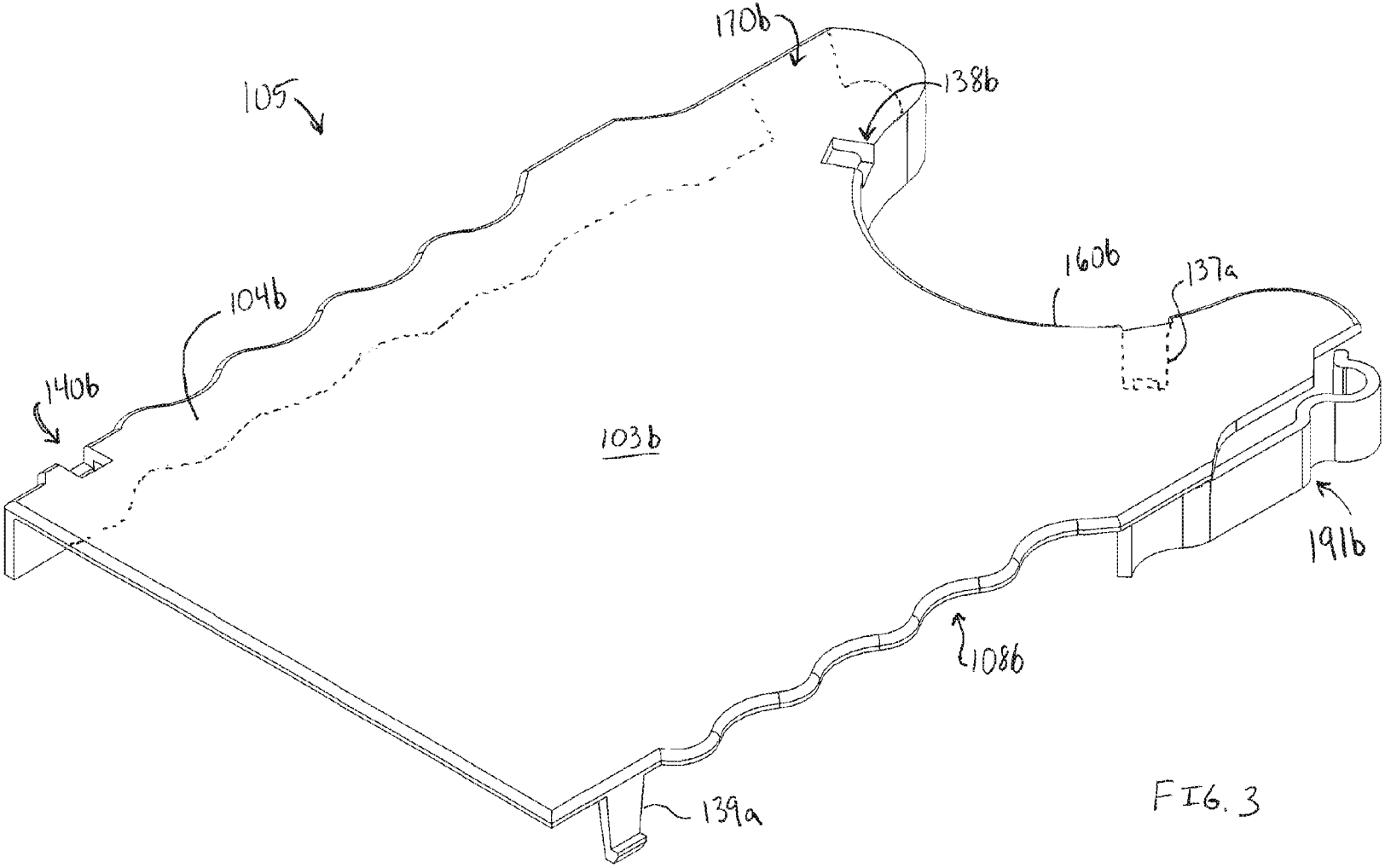
FIG. 3 illustrates a top case body of the dispenser, according to one embodiment.
Figure 3A:
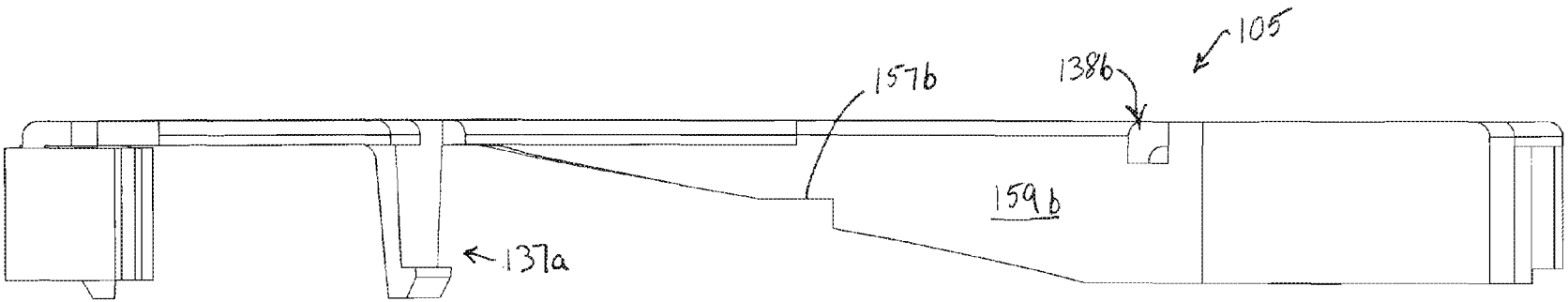
FIG. 3A illustrates the top case body of the dispenser as viewed along the y-axis as defined in FIG. 4.
Figure 3B:
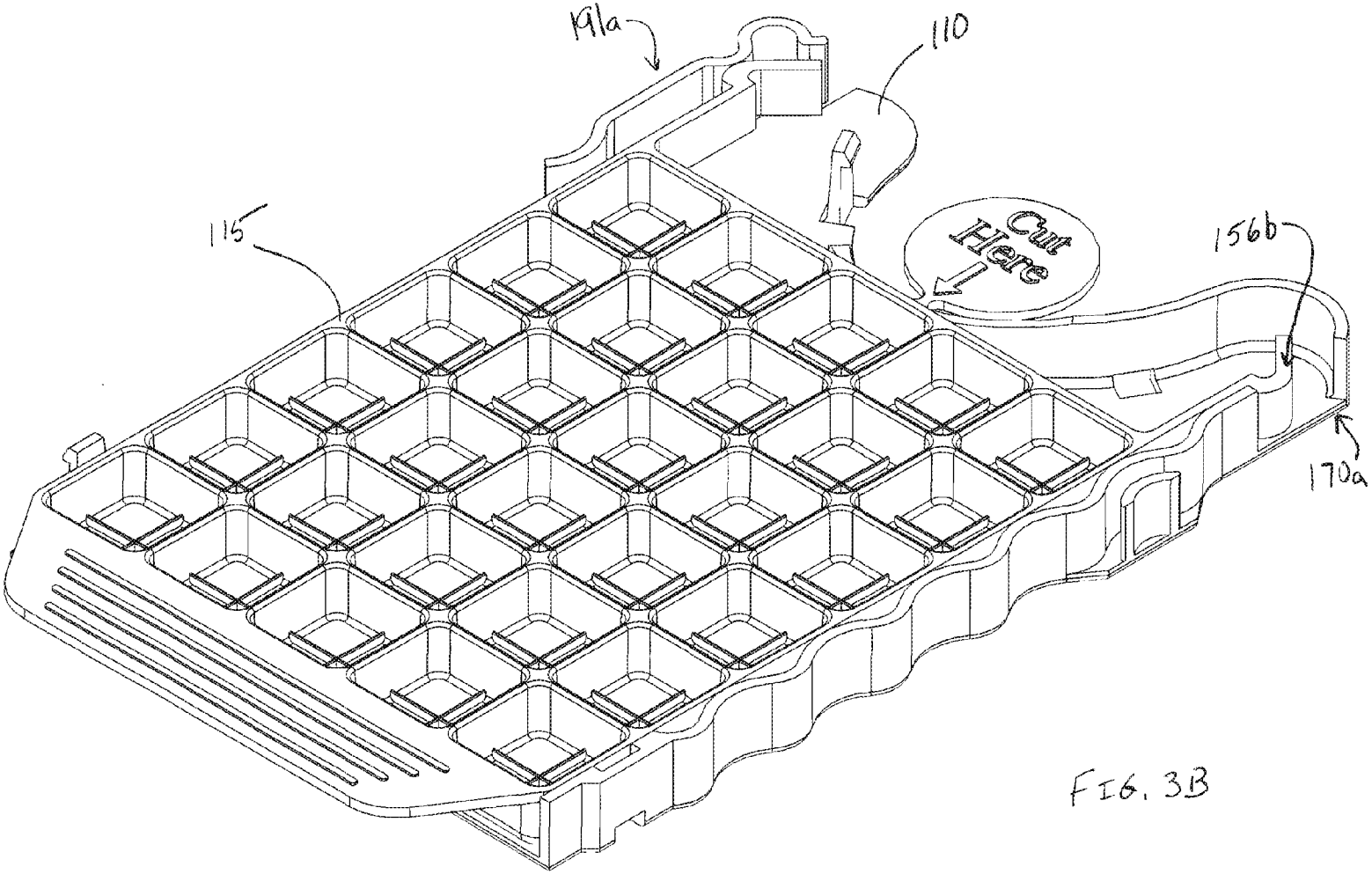
FIG. 3B illustrates the tray member disposed within the bottom case body, according to one embodiment.
Figure 2C:
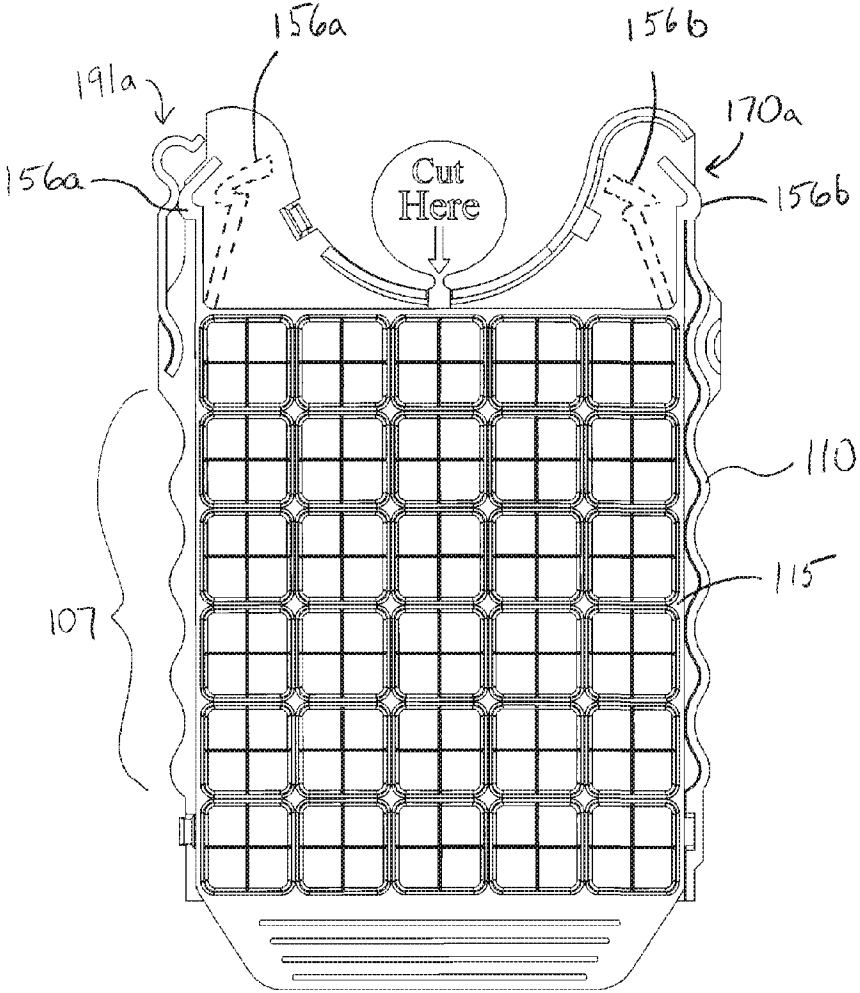

Referring specifically to FIG. 2, in this embodiment, the tray member 115 includes a compartment array 121 of receptacles 119. In this embodiment, the receptacles 119 each include a floor 180 and four conjoined walls 181 that form a cube with one face (the top face in the illustration of FIG. 2) absent, as illustrated. In this embodiment, the tray member 115 further includes a tab member 117 configured to be graspable by a user, e.g., by the thumb and forefinger. In a preferred embodiment, the receptacles 119 can be formed from a plastic material that is chemically inert with respect to the intended contents of the receptacle, e.g., pharmaceutical compounds. Exemplary plastics include, without limitation, food-grade plastics.

In this embodiment, the tray member 115 includes a first flexible locking arm 131*a* and a second flexible locking arm 131*b* that extend from a front edge 135 of the tray member 115 (along the y-axis) as illustrated. As described in further detail herein, flexible locking arms 131*a*, 131*b* can cooperate with recesses in the assembled case 101 to provide a releasable locking mechanism that holds the tray member 115 within the case 101.

In this embodiment, the tray member 115 further includes a circle-shaped stop-tab 125 which is conjoined with the tray member 115 via neck member 127 which itself is disposed on the front edge 135. As described in greater detail herein, the stop-tab 125 serves to prevent the tray member 115 from being removed from the case 101 until the stop-tab 125 is removed by the user.

Referring again to FIGS. 1-5, in this embodiment, the case 101 includes a semi-circle-shaped recess 160 (see, e.g., FIG. 4) defined in part by a C-shaped recess 160*a* in the bottom case wall 103*a* and C-shaped recess 160*b* in the top case wall 103*b* (FIGS. 1 and 3, respectively). In this embodiment, the case can be assembled in an operable configuration by aligning the C-shaped walls 160*a*, 160*b* of the bottom case body 110 and the top case body 105, respectively, and bringing the top case body 105 and bottom case body 110 into a substantially confronting relationship as illustrated, e.g., in FIG. 4. In this embodiment, doing so also aligns the aforementioned locking tab/recess systems 137, 138, 139, 140 into an engagable orientation so that the top case body 105 and bottom case body 110 can be locked together in a substantially confronting relationship.

Figure 5:
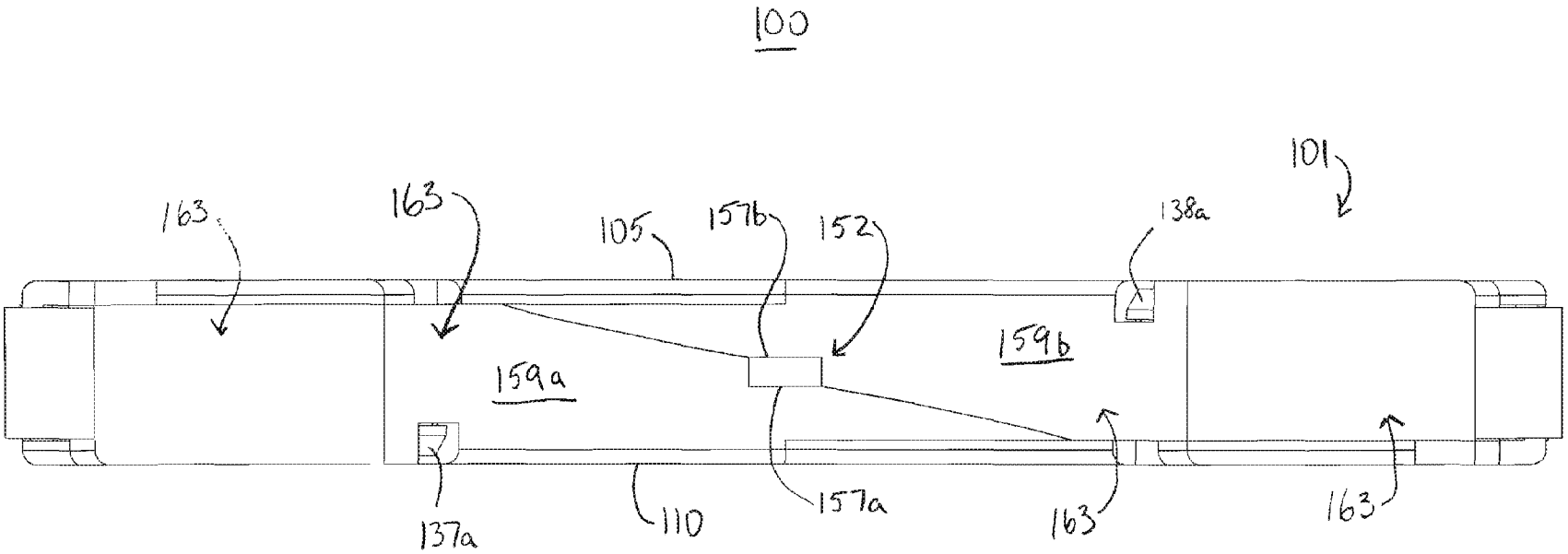
FIG. 5 illustrates the top case body and the bottom case body assembled in a substantially confronting relationship as viewed along the y-axis defined in FIG. 4.
Figure 6:
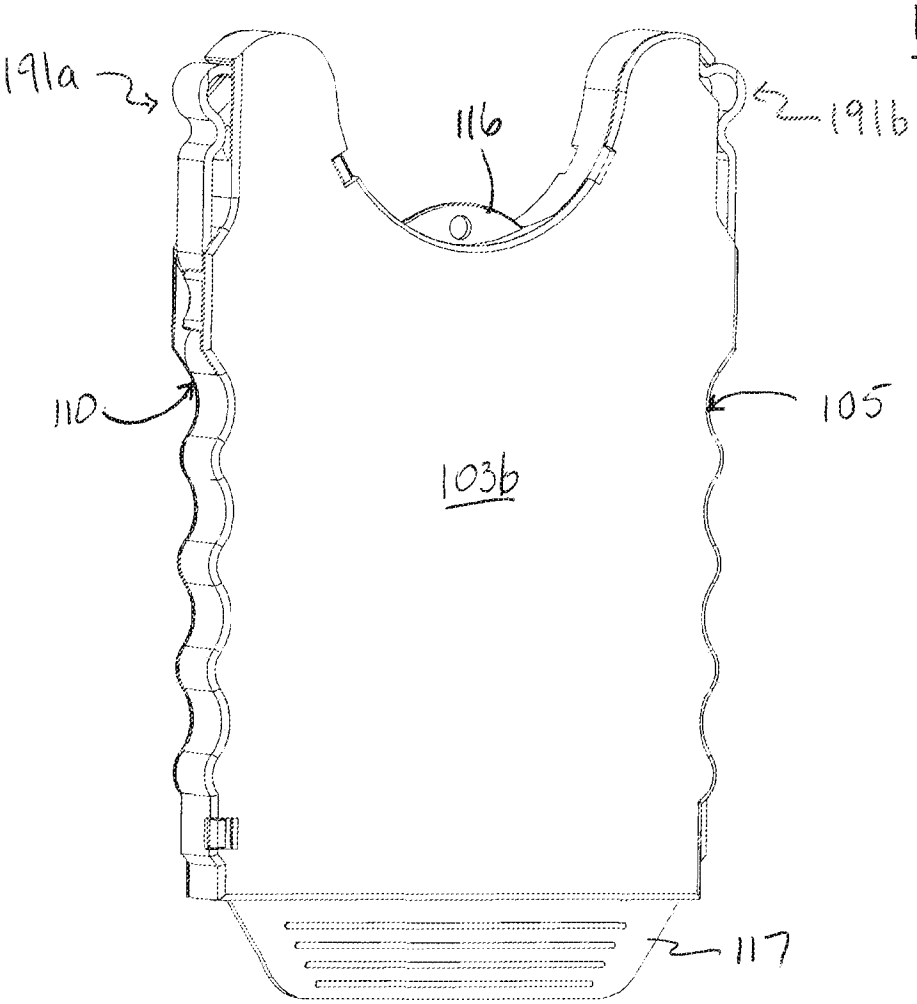
FIG. 6 illustrates a dispenser in an assembled configuration, according to one embodiment.
Figure 7:
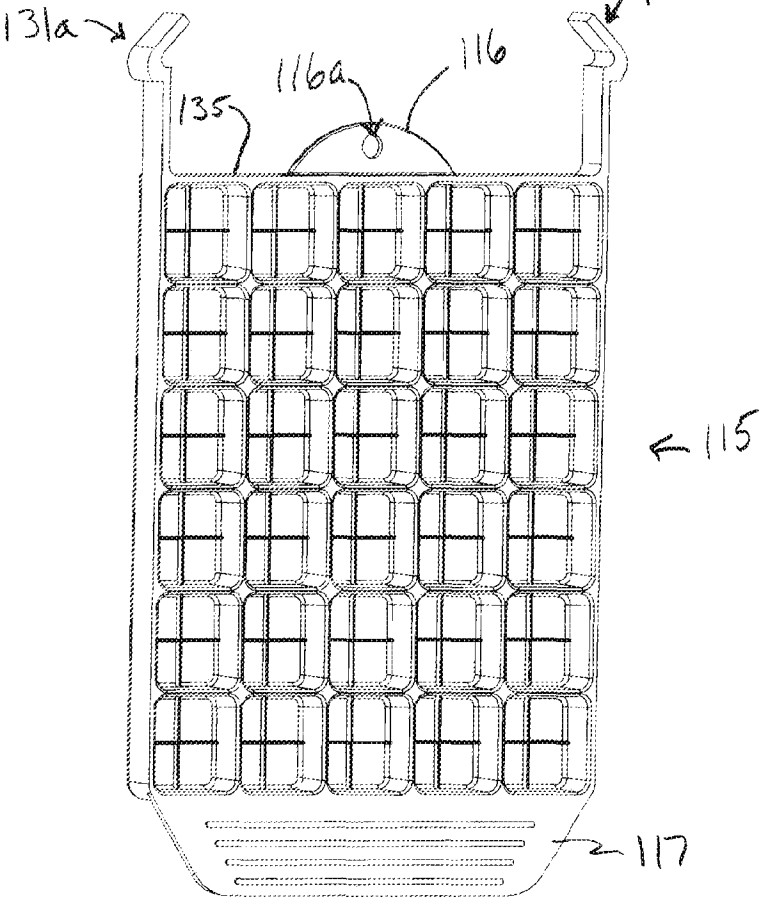
FIG. 7 illustrates a tray member of a dispenser, according to one embodiment.
Figure 8:
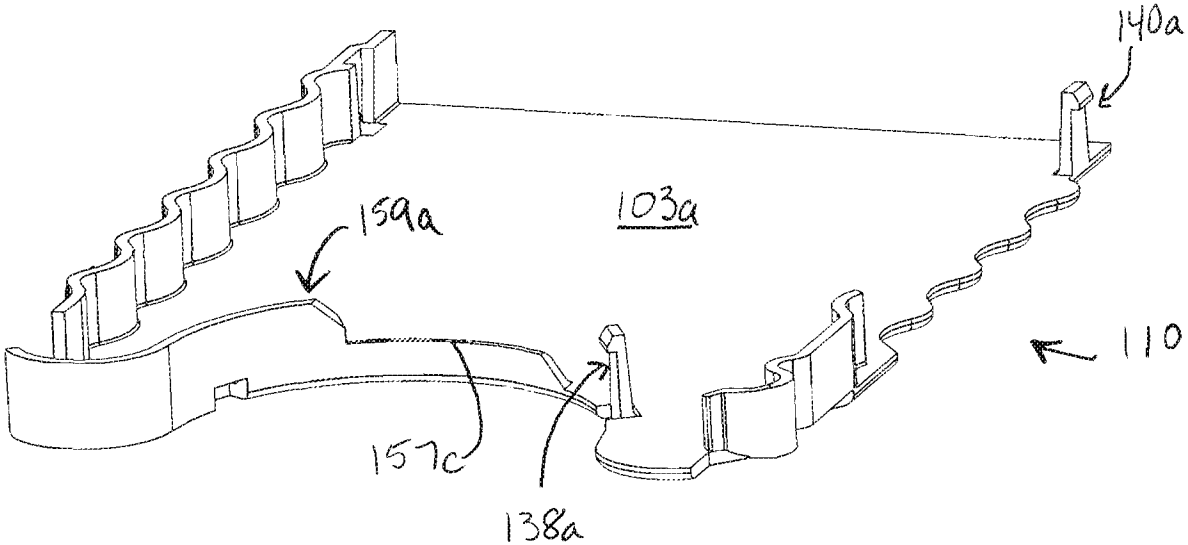
FIG. 8 illustrates a bottom case body of a dispenser, according to one embodiment.
Figure 9:
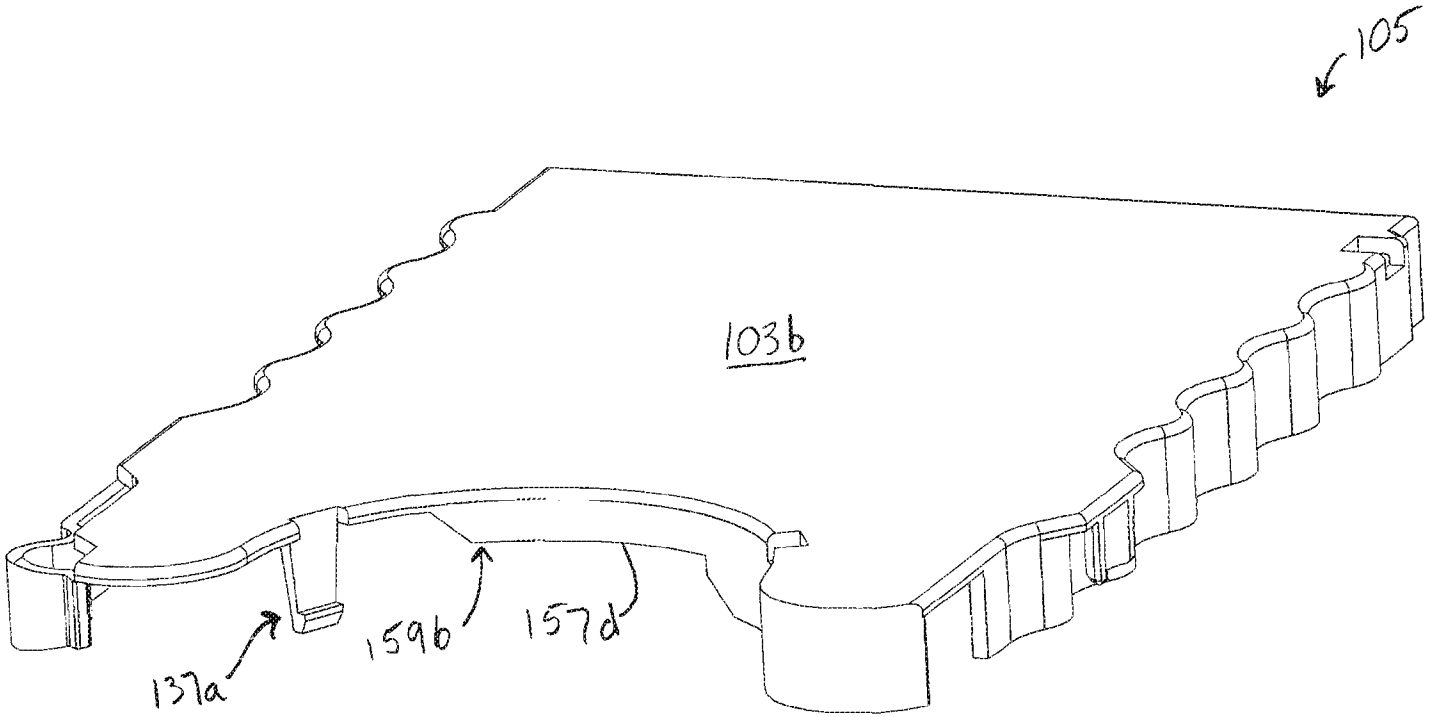
FIG. 9 illustrates a top case body of a dispenser, according to one embodiment.
Figure 10:
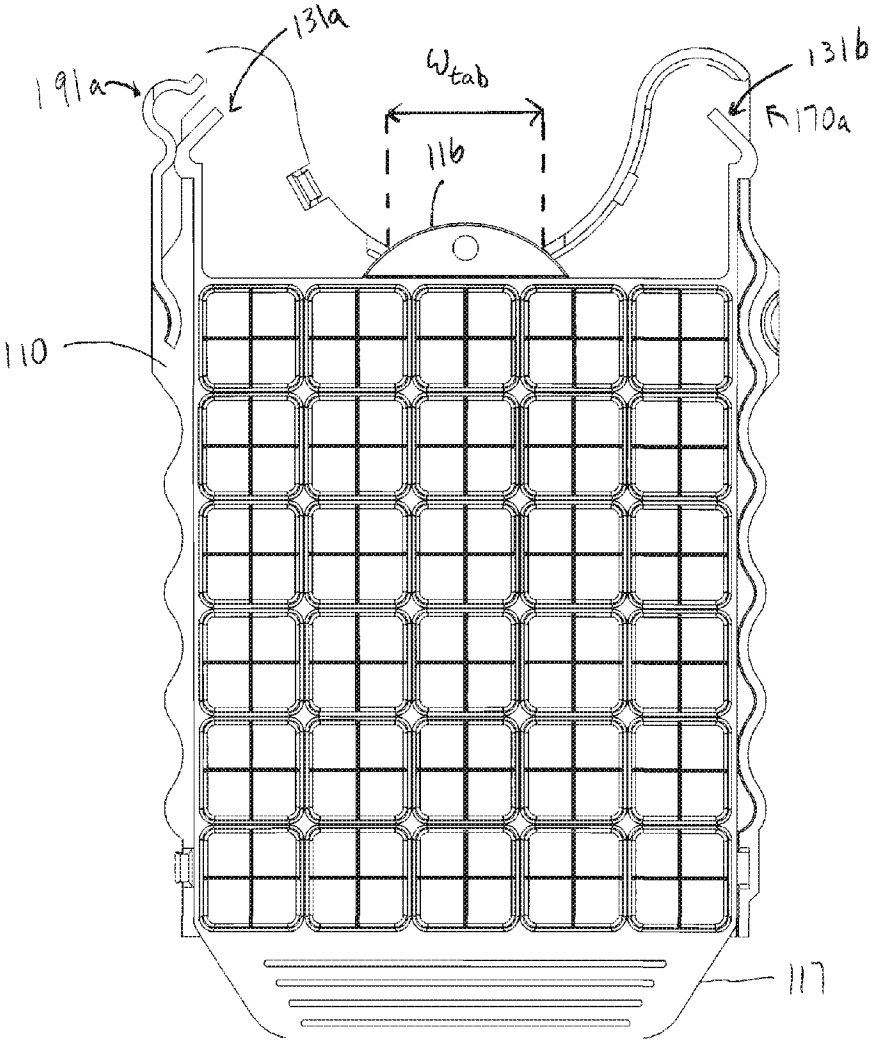
FIG. 10 illustrates a tray member housed in a bottom case body of a dispenser, according to one embodiment.

Referring particularly to FIG. 5, in this embodiment, the bottom case body 110 and the top case body 105 each include a sloped wall 159*a*, 159*b*, respectively, and each sloped wall 159*a*, 159*b* includes a shelf portion 157*a*, 157*b*, respectively. The sloped walls 159*a*, 159*b* of each of the top case body 105 and bottom case body 110 can be configured such that when the case 101 is assembled, the shelf portions 157*a*, 157*b* define, in part, an aperture 152 in the top wall 163 of the case 101 as illustrated. In this embodiment, the aperture 152 is configured to receive the neck 127 of the stop-tab 125, preferably, with minimal distance between the neck 127 and the surrounding aperture 152. Thus, the tray member 115 can be lockingly enclosed in the case 101 while the neck member 127 of the stop-tab 125 protrudes through the aperture 152 of the top wall 163, and the tab member 117 protrudes from a bottom portion 167.

In this embodiment, the case 101 includes oppositely-disposed, first and second rectangular apertures, 170*a*, 170*b*, respectively, for receiving elbow portions 156*a*, 156*b*, of flexible locking arms 131*a*, 131*b*, respectively. In this embodiment, flexible locking arms 131*a*, 131*b* are configured so that the elbow portions 156*a*, 156*b* are normally biased into the apertures 170*a*, 170*b* respectively and can prevent the tray member 115 from shifting within the case 101 until the elbow portions 156*a*, 156*b* are shifted into a tray-releasing configuration. In one embodiment, a tray-releasing configuration of the elbow portions 156*a*, 156*b* is one in which the elbows 156*a*, 156*b* have been shifted substantially toward each other and out of each respective aperture 170*a*, 170*b*. Referring specifically to FIG. 3C, flexible locking arms 131*a*, 131*b* are shown in a locked configuration (solid lines) and in a releasing configuration as illustrated by the dashed lines (referred to by reference numerals 192*a*, 192*b*).

In this embodiment, when the dispenser 100 is in an assembled configuration, e.g., as shown in FIG. 4, a user can shift the flexible locking arms 131*a*, 131*b* between the locked configuration and the releasing configuration by applying substantially simultaneous inward force to flexible arms 191*a* and 191*b*, thereby urging elbow portions 156*a*, 156*b* of the flexible locking out of, and away from the apertures 170*a*, 170*b*.

In this and other embodiments, the resilience of flexible arms 191*a*, 191*b* and flexible locking arms 131*a*, 131*b* can be selected so as to minimize the likelihood of a child unlocking the tray member 115, e.g., shifting the flexible locking arms 131*a*, 131*b* into a releasing configuration. Such selection can be made by choosing appropriate materials for the flexible arms 191*a*, 191*b* and the flexible locking arms 131*a*, 131*b*, which can include resilient plastics, metals, or other materials.

In general, the dispenser 100 can provide both prevention of access to the contents of the compartment array 121 by children and evidence of tampering. For example, when the tray member 115 is enclosed in the case 101, the tray member 115 is substantially precluded from shifting out of the case 101 because the width of the stop tab 125 and the width of the front edge 135 are each greater than the width of the aperture 152. Thus, the extent that the tray 115 can shift along the y-axis can be limited in part by the length of the neck member 127. In one example of evidence of tampering, a user can recognize if the stop tab is missing, which can be indicative that the contents of the compartment array 121 have been tampered with, compromised or polluted. In another aspect, the dispenser 100 provides child-proof protection of the compartment array 121 by virtue of the flexible locking arms 131*a*, 131*b* continuously biasing the elbow portions 156*a*, 156*b* through the apertures 170*a*, 170*b* of the case 101, until that bias is overcome by a user applying inward force to flexible arms 191*a*, 191*b* as described herein. In some embodiments, the width w of the case 101 (as illustrated in FIG. 4) can be chosen to be larger, on average, than the size of a child's hand, so that substantially only an adult has the capability of grasping the case 101 with one hand and operating the flexible arms 191*a*, 191*b* to release the tray member 115 with the other.

In general, the tray member 115 can be configured to hold any type of selected pharmaceutical compound or other substance where restricted access by children or other un-authorized person is desired. For example, the tray member 115 can be configured as a sealed box containing pills, tablets, powders, or other substance forms. In another example, the tray member 115 can be configured to retain liquids, e.g., by incorporating blister packs or other types of sealed medication storage systems.

In a preferred embodiment, the tray member 115 can be configured to receive troche ingredients as prepared by a pharmacist. In such an embodiment, a pharmacist can prepare a troche solution and dispense it in one or more receptacles (e.g., receptacle 119) of the compartment array 121. The tray member 115 can then be assembled within the case 101 as described herein to provide both child proofing and tamper evidency of the medication.

In one embodiment, the tray member 115 can be translated out of the case 101 in incremental steps as generally defined by the spacing of the plurality of recesses 107. For example, as the tray member 115 is removed from the case (in the –y direction as illustrated in FIG. 4), the bias of the flexible locking arms 131*a*, 131*b* will continue to urge the elbow portions 156*a*, 156*b* outward, e.g., against the side walls 104*b*, 104*a*, respectively of the case 101. The elbow portions 156*a*, 156*b* can thus engage recesses along the walls 104*a*, 104*b* to provide incremental translation of the tray member 115 relative to the case 101. In general, once the tray member 115 has been unlocked from the case 101, e.g., the elbow portions 156*a*, 156*b* have been shifted out of the apertures 170*a*, 170*b*, a user can continue to shift the tray member 115 out of the case 101 by pulling tab member 117 with sufficient force to overcome the bias of the elbow portions 156*a*, 156*b* within the recesses of the side walls 104*a*, 104*b*.

Referring now to FIGS. 6-11, in an alternative embodiment, the dispenser 100 can provide tamper-resistance, tamper evidence, or both, utilizing an alternative to the stop tab 125 described with respect to FIGS. 1-5. In the description of FIGS. 6-11, some reference numerals to previously-described case 101 elements have been omitted for figure clarity. In this embodiment, the tray member 115 includes a crescent-shaped tab 116 that extends from the front edge 135 as illustrated particularly with respect to FIG. 7. In this embodiment, the tab 116 includes an aperture 116*a* configured to receive a locking mechanism. Exemplary locking mechanisms include, without limitation, sealable wires, string, ties, zip-ties, lock-ties, and the like.

Figure 11:
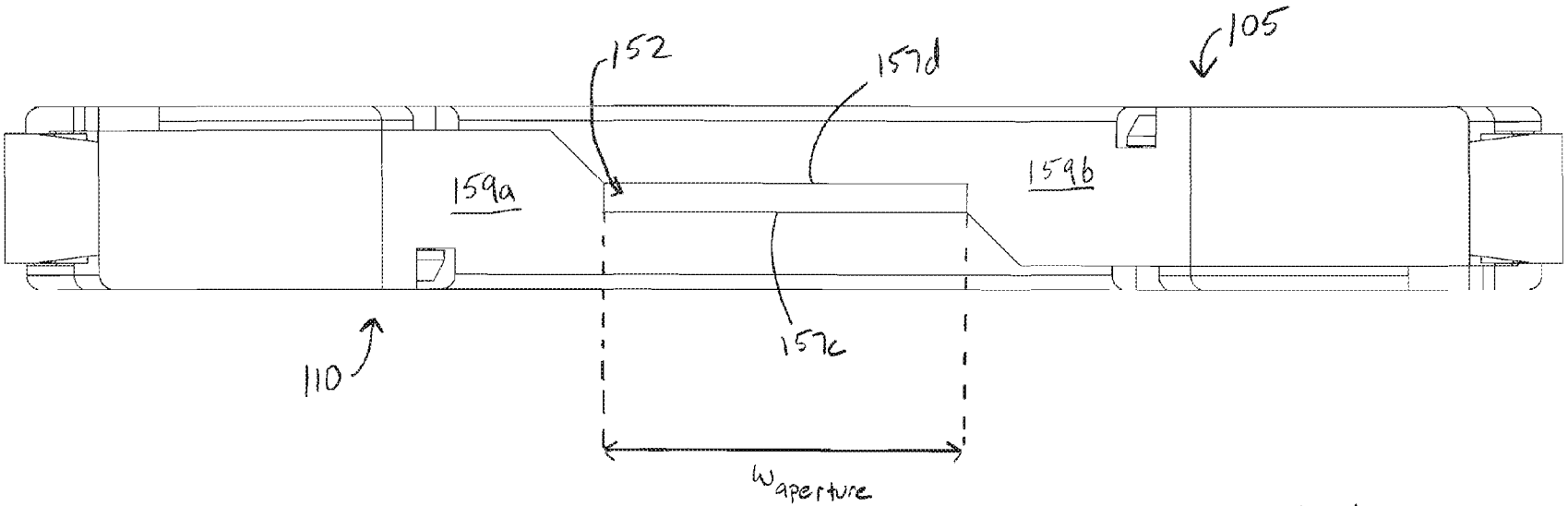
FIG. 11 illustrates a top view of a dispenser without a tray member, according to one embodiment.

In this embodiment, the sloped walls 159*a*, 159*b* of the bottom case body 105 and the top case body 110, respectively, include shelf portions 157*c*, 157*d*, respectively that are configured to accommodate a portion of the tab 116 that extends out of the case 101. In this embodiment, the portion of the tab 116 having width $w_{tab}$ that extends through the aperture 152 can be defined by the width $w_{aperture}$ as illustrated in FIG. 11.

In this embodiment, the tab 116 can be used to prevent the tray member 115 from being removed from the case 101 until the locking mechanism is removed. Thus, a missing or damaged locking mechanism can provide evidence that the dispenser 100 has been tampered with, similar to the function of the stop tab 125 previously described.

Referring now to FIGS. 12-23, a child-resistant and tamper-evident medication dispenser 500 is illustrated according to one embodiment.

In this embodiment, the medication dispenser 500 includes a bottom case body 501, a top case body 530, and a tray member 515 that are configured similar to the troche dispenser 100 described with respect to FIGS. 1-11, above. For example, the bottom case body 501 and top case body 530 are configured to join together to form a chamber 540 in which the tray member 515 can securely fit in a child-resistant and tamper evident configuration. The tray member 515 can be slidingly removed from the chamber 540 by concurrently defeating the child-resistant locking mechanism which, in this embodiment, includes concurrently shifting first (508) and second (509) lock-release tabs toward one another as described more fully below, and pulling outwardly on the tab member 516 to remove the tray. Tamper evidency of the tray member 515 can be achieved by visualizing the conditions of a stop tab member 521 or indica members attached thereto which extends outside of the chamber 540, through a stop-aperture 551 within a wall cooperatively defined by wall members 506 and 534 of the bottom and top case body members, respectively.

Figure 14:
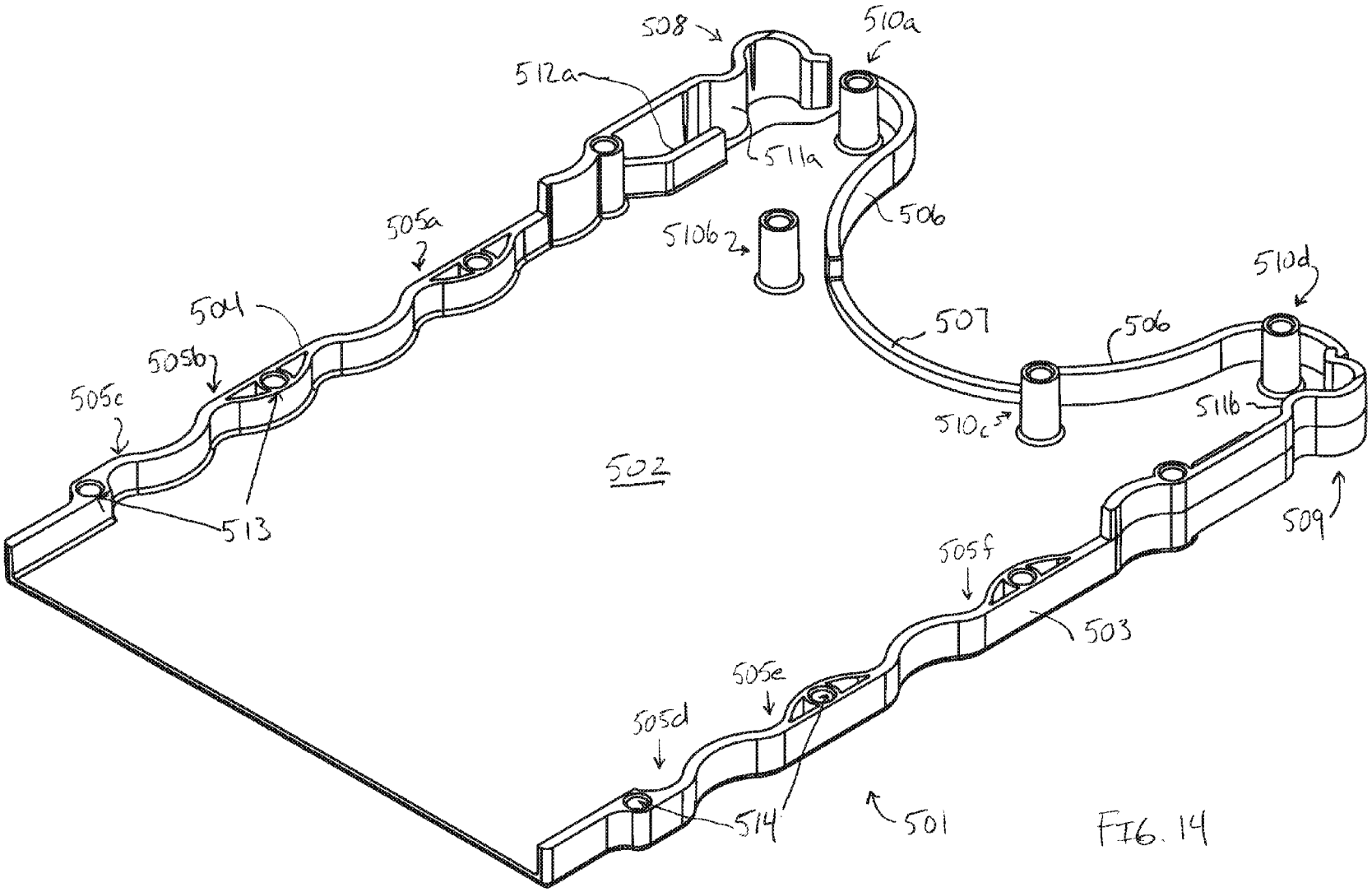
FIG. 14 shows a bottom case body of a child-resistant and tamper-evident medication dispenser according to one embodiment.
Figure 15:
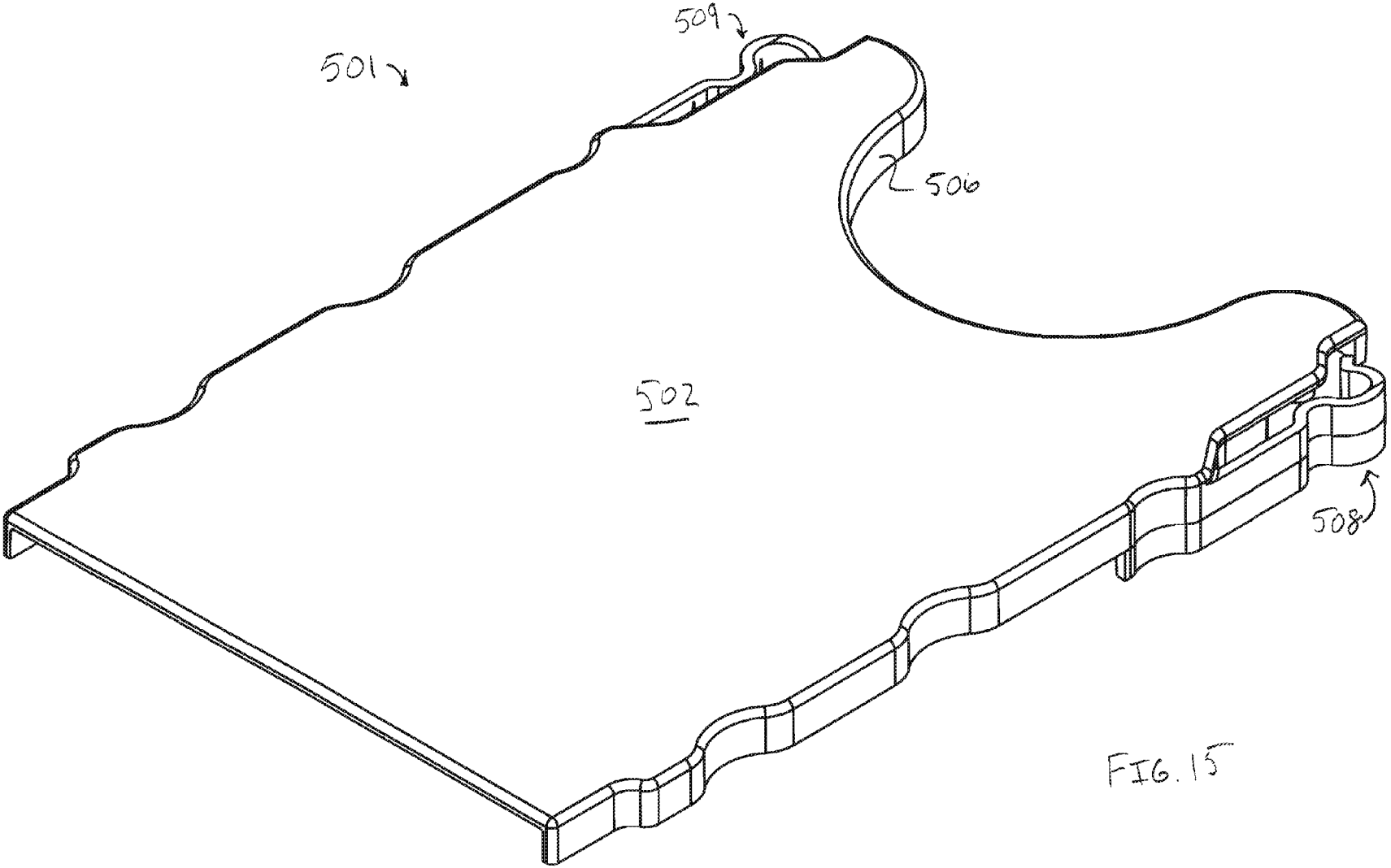
FIG. 15 shows the opposite side of the bottom case body shown in FIG. 14.
Figure 16:
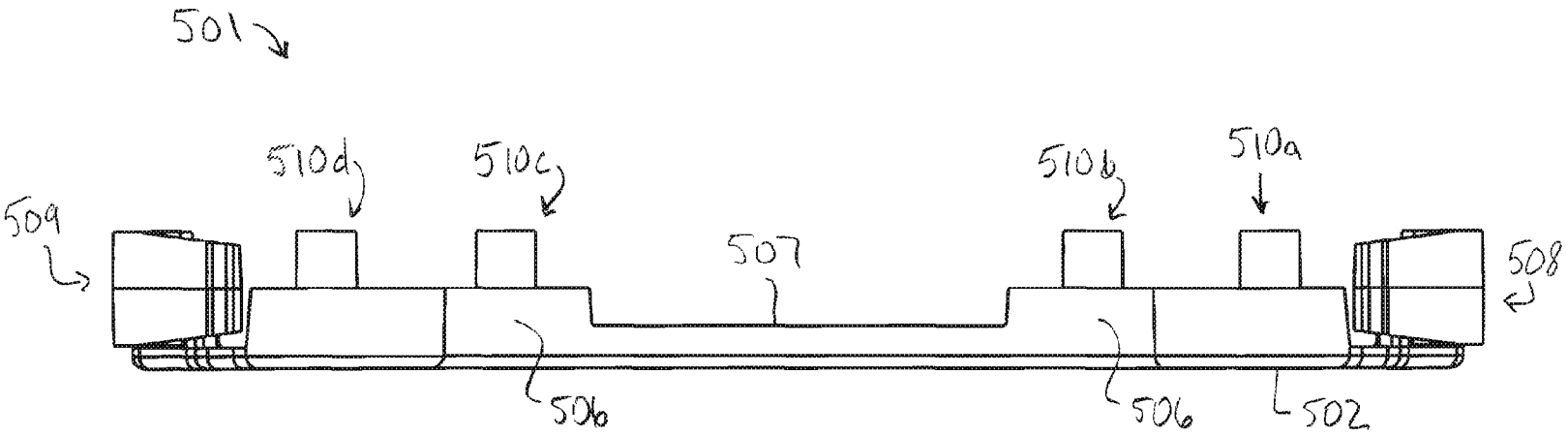
FIG. 16 shows a top-side perspective view of the bottom case body shown in FIG. 14.

Referring specifically to FIG. 14, in this embodiment, the bottom case body 501 includes a floor member 502 from which a front wall member 506 extends in a substantially perpendicular orientation as illustrated. In this embodiment, the front wall member 506 is C-shaped and includes a notch 507 that forms a portion of the stop-aperture 551 (see, e.g., FIG. 23) for receiving the stop tab member 521 when the dispenser is assembled, as illustrated, e.g., in FIG. 12.

In this embodiment, the bottom case body 501 further includes first (503) and second (504) wall members extending perpendicularly from the floor member 502 as illustrated. The first and second wall members are shaped so as to create recesses, e.g., recesses 505*a*-505*f* for allowing the tray member to be incrementally-shifted while being removed from the chamber 540 as described in greater detail below.

In this embodiment, the bottom case body 501 further includes first (508) and second (509) resiliently flexible engagement arms similar to the flexible arms 191*a*, 191*b* described above. The engagement arms are configured to allow an engagement surface, e.g., engagement surface 511*a* on engagement arm 508 to contact an engagement surface 520 on a flexible locking arm 517 of the tray member 515 (see, e.g., FIG. 17). The engagement arms 508, 509 are configured such that they are resiliently inwardly flexible so that the engagement surfaces 511*a*, 511*b* can be shifted toward one another.

In this embodiment, the bottom case body 501 further includes first (512*a*) and second (512*b*) substantially rigid stop arm members that extend perpendicularly from the floor member 502 as illustrated. The stop arm members 512*a*, 512*b* are configured to extend toward, but not in abutting relationship to the front wall 506, so as to create a gap therebetween. In this embodiment, the gap between the terminuses of the arm members 512*a*, 512*b* and the front wall member 506 forms engagement apertures for receiving the engagement portions (520, 519) of the flexible engagement arms 517, 518 respectively. See, e.g., FIG. 19. In this embodiment, each stop arm member 512*a*, 512*b* includes a distal end configured to engage the engagement surface 520, 519 of each flexible locking arm 517, 518 respectively. As particularly illustrated in FIG. 19, as the tray member 115 rests within the bottom case body 501, the engagement surfaces 520, 519 abut the distal ends of the stop arm members 512*a*, 512*b*, respectively, thus preventing the tray member 115 from shifting rearward, in the −y direction out of the bottom case body. In addition, the wall member 506 prevents the tray member 515 from shifting forward, in the +y direction, as illustrated.

In this embodiment, the bottom case body 501 further includes hollow post members 510*a*-510*d* which cooperate with post members 535*a*-535*d* on the top case body 530 (see e.g., FIG. 20) to securely join the bottom case body 501 to the top case body 530. In this embodiment, the hollow post members (510*a*-510*d*) and the post members (535*a*-535*d*) are arranged such that they assist to align the side walls 503, 504 and the front wall 506 with corresponding side walls 532, 533 and front wall member 534 that extend perpendicularly from a top wall member 531 of the top case body 530.

Figure 12:
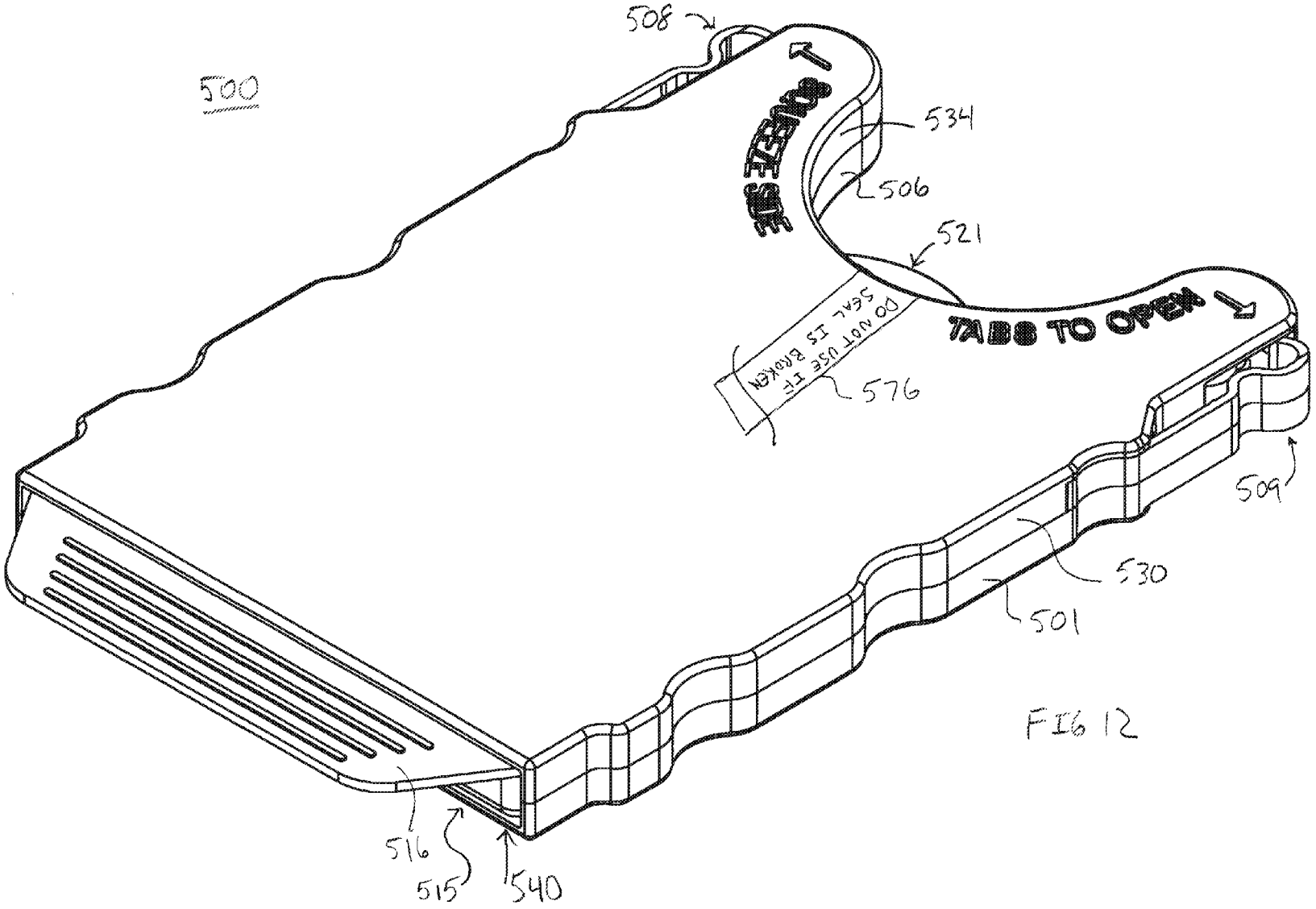
FIG. 12 shows an isometric view of a child-resistant and tamper-evident medication dispenser according to one embodiment.
Figure 20:
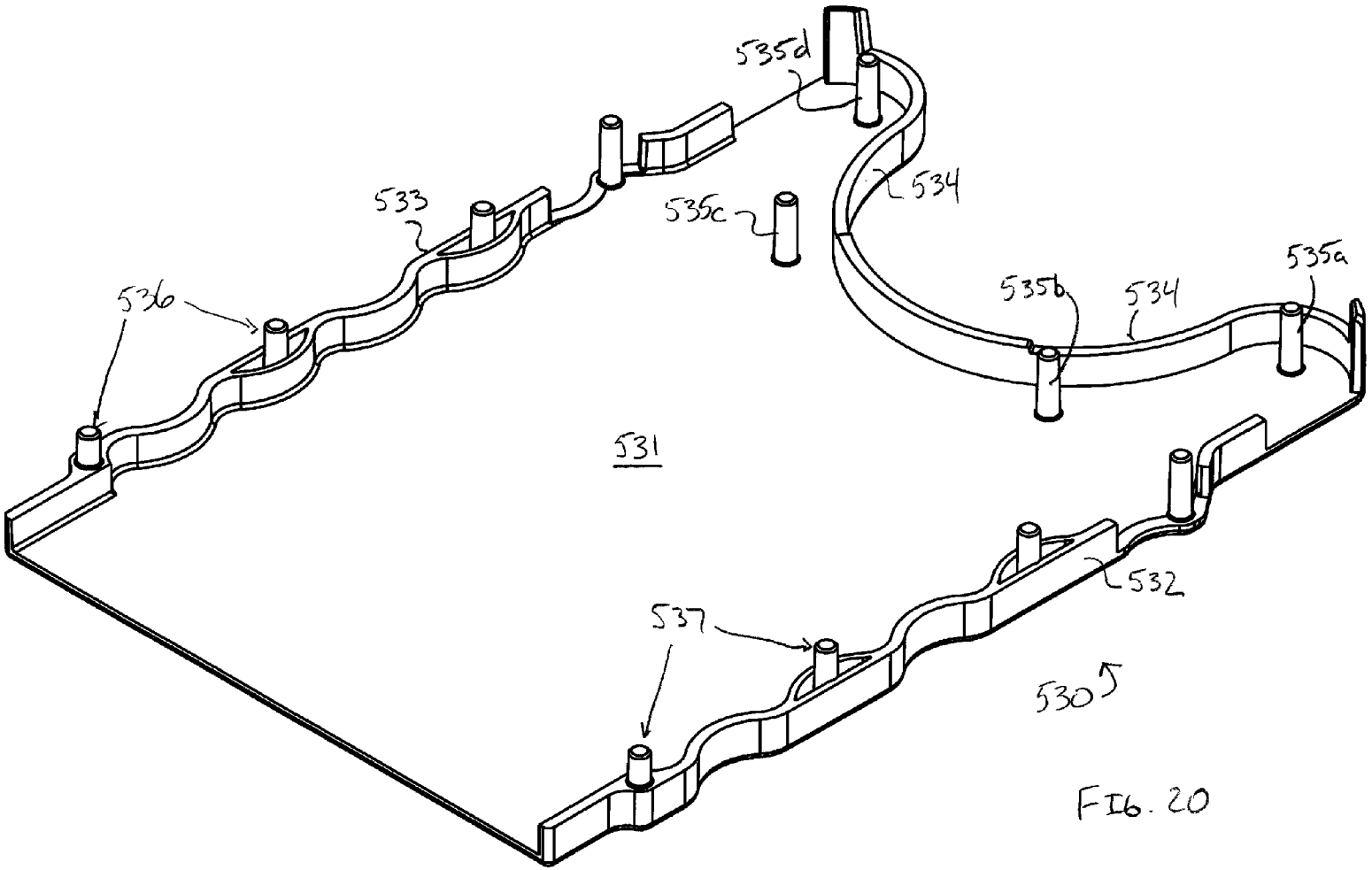
FIG. 20 shows a top case body according to one embodiment.
Figure 21:
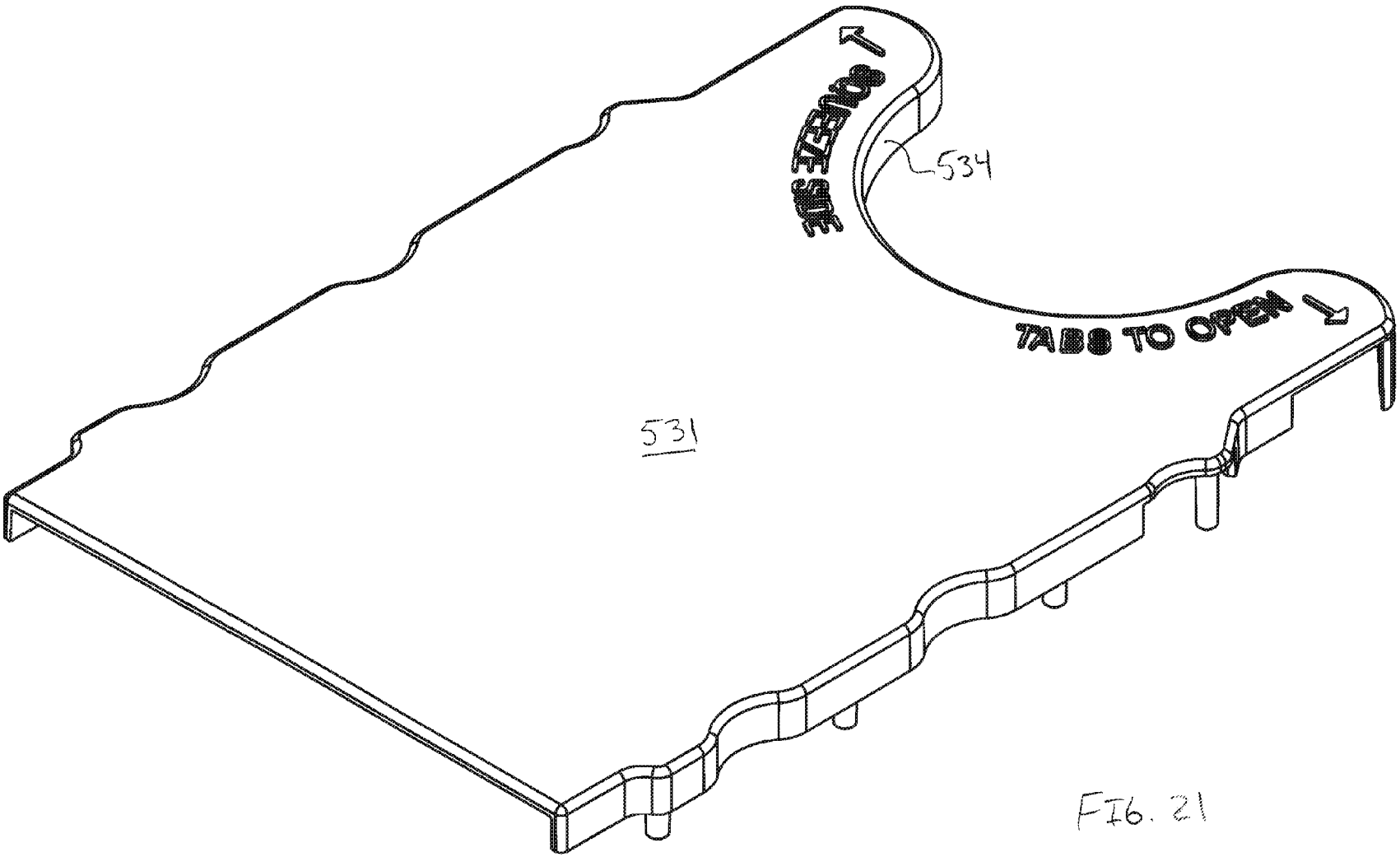
FIG. 21 shows an opposite side of the top case body shown in FIG. 20.
Figure 22:
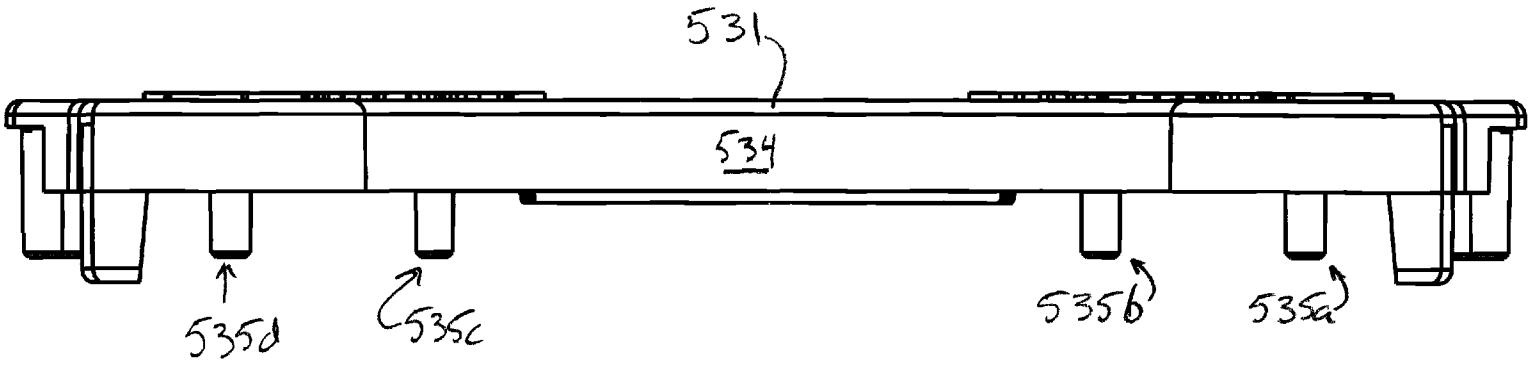
FIG. 22 shows a top-side perspective view of the top case body shown in FIG. 20.
Figure 23:
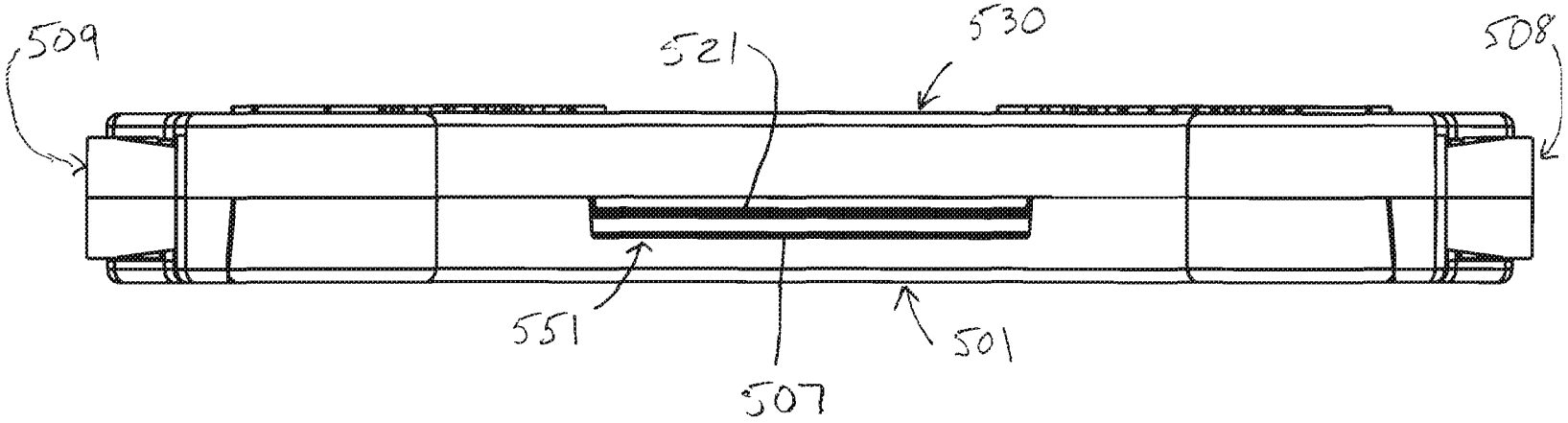
FIG. 23 shows a top-side perspective view of the assembled child-resistant and tamper-evident medication dispenser shown in FIG. 12.

Referring to FIG. 20, in this embodiment, the top case body 530 includes post members 536, 537 that extend vertically from the side walls 532, 533 as illustrated. Referring to FIG. 14, in this embodiment, the bottom case body 501 includes complimentary recesses 513, 514 for receiving the post members (536, 537) of the top case body 530 to further align and strengthen the union between top and bottom case bodies when the dispenser is in an assembled configuration, e.g., as illustrated in FIG. 12. In this and other embodiments, each of the top and bottom case body members can include as many post/recess combinations as desired.

Figure 17:
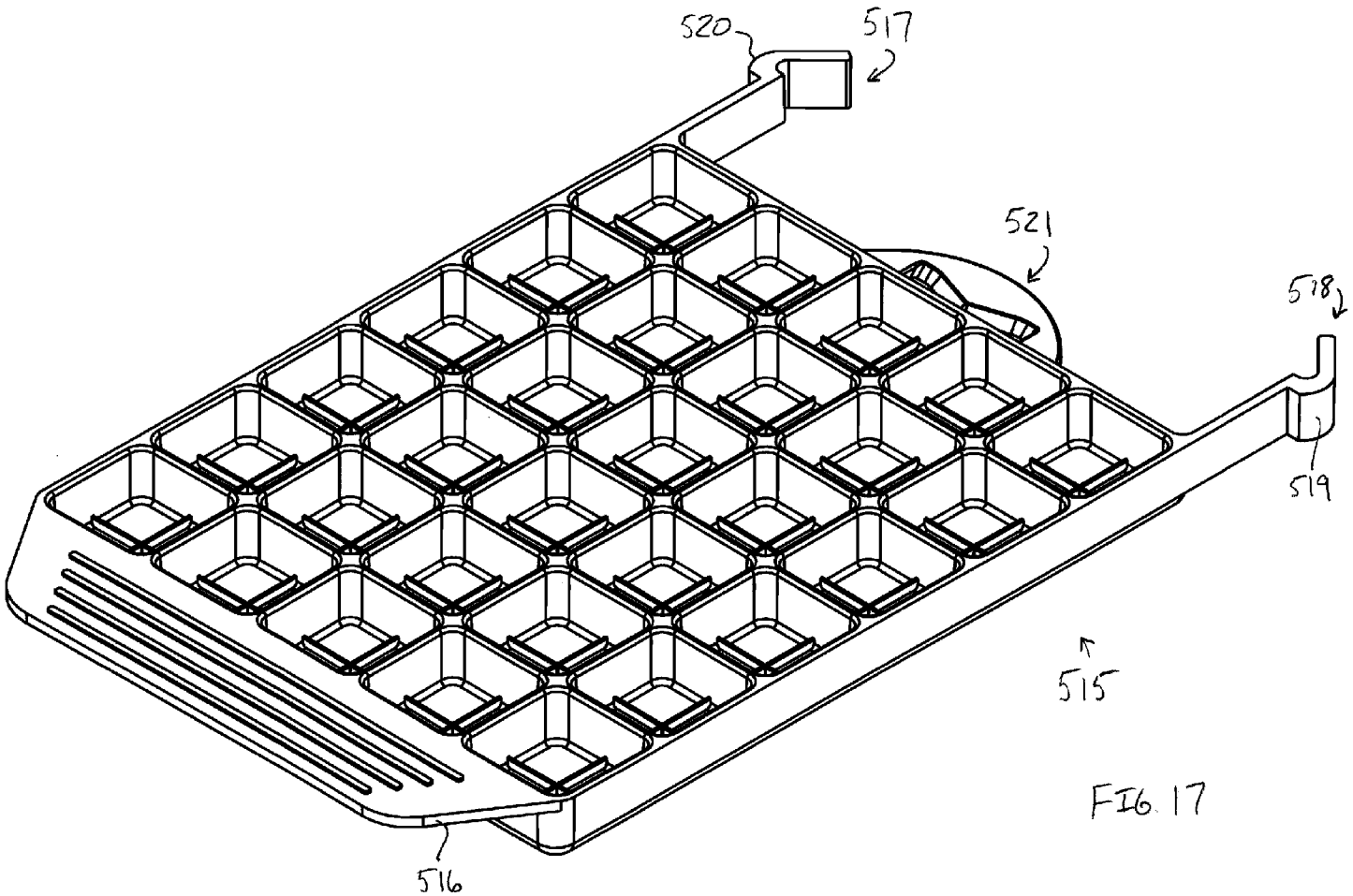
FIG. 17 shows a tray member according to one embodiment.
Figure 18:
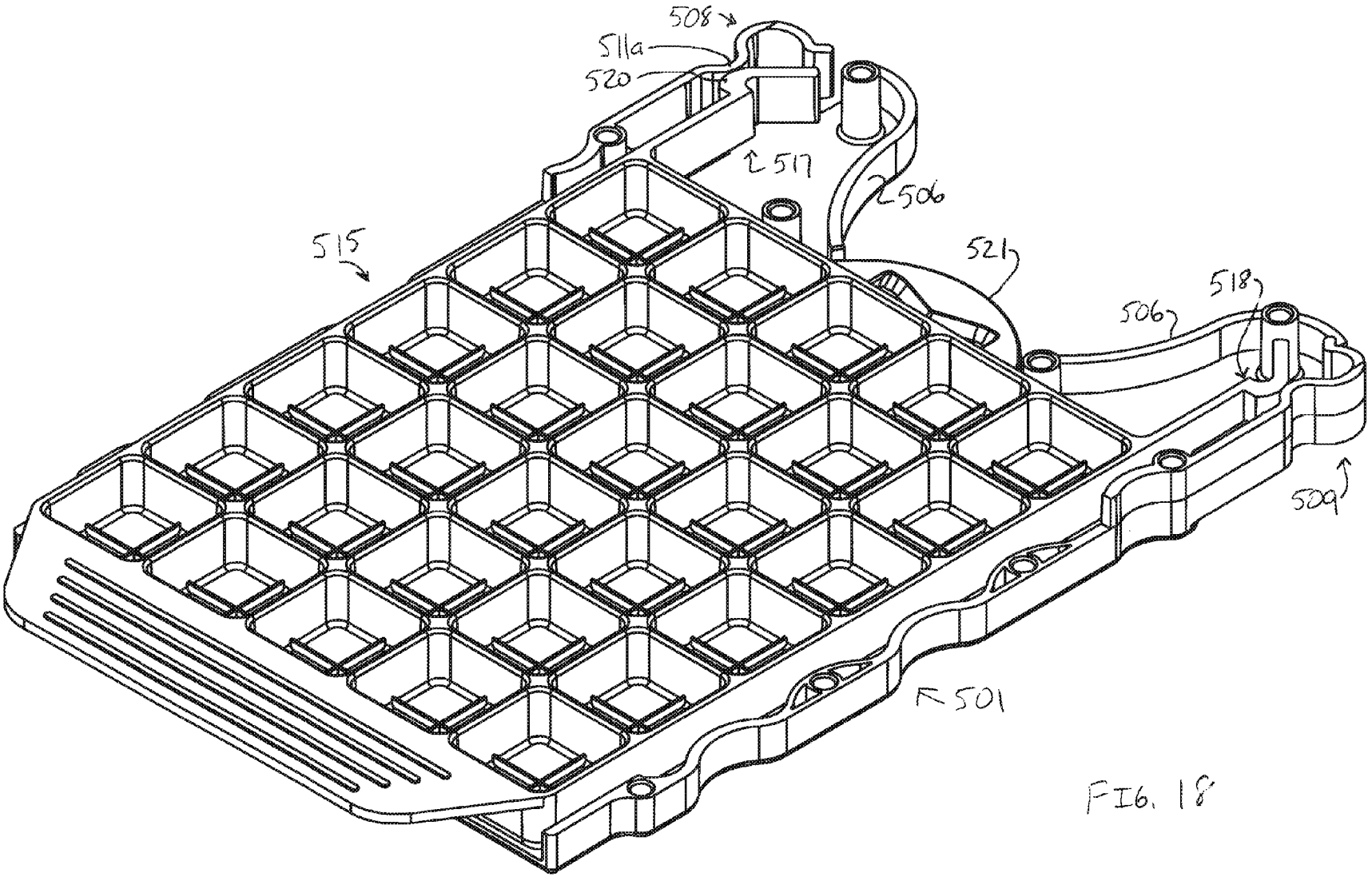
FIG. 18 shows the tray member of FIG. 18 resting within the bottom case body shown in FIG. 14.

Referring to FIG. 17, in this embodiment, the tray member 515 is similar to tray member 115 described above and illustrated in this example as a troche tray. Other medication dispensing configurations are equally contemplated, however, and it should be understood that each of the bottom and top case bodies can be modified, as well as the tray member, to accommodate a variety of medication types and forms.

Figure 13:
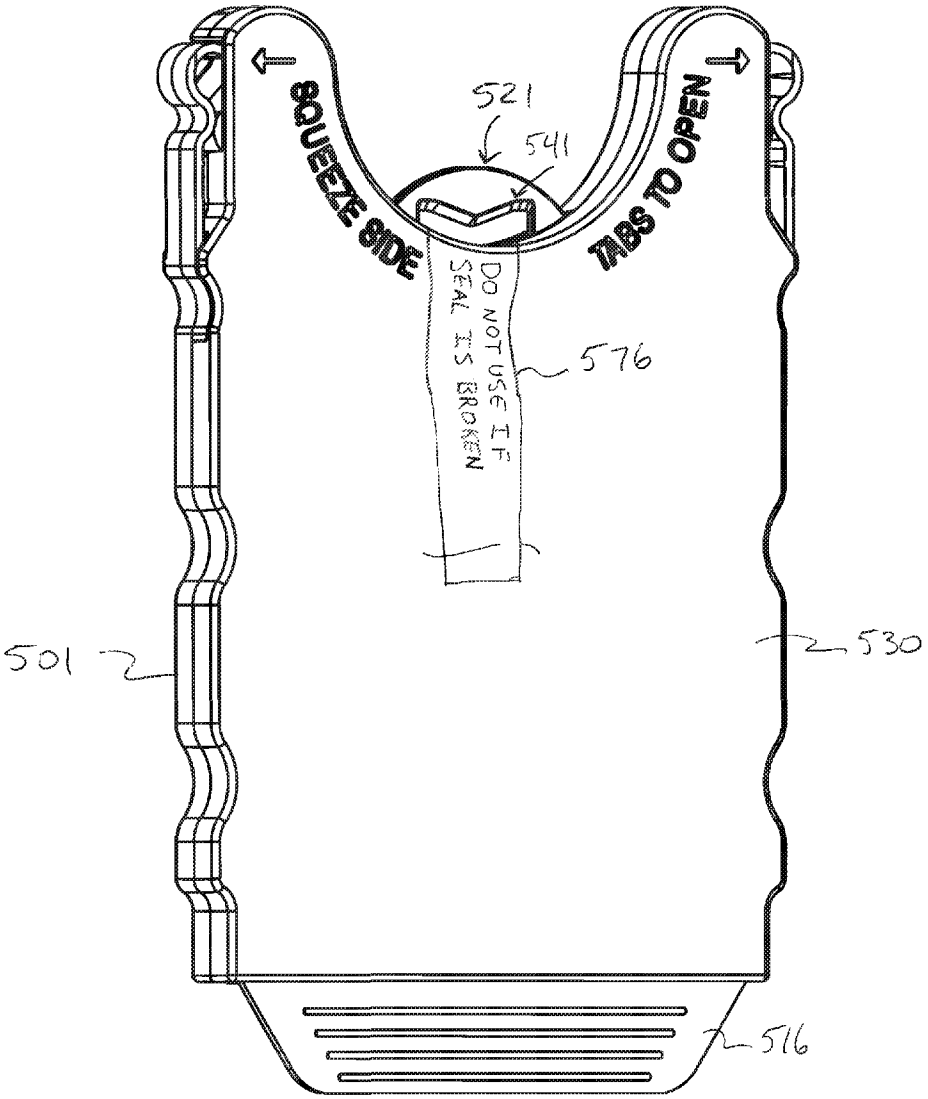
FIG. 13 shows a different isometric view of the child-resistant and tamper-evident medication dispenser of FIG. 12.

In this embodiment, the tray member 515 includes a stop tab 521 configured to extend through the stop-aperture 551 and includes an aperture 541 (see, e.g., FIG. 13) through which a tamper-evidency mechanism may be placed or attached. In this embodiment, the tamper-evidency mechanism is a length of plastic tape 576 that is attached to the top case body 530, extends through the aperture 541, and is attached to the bottom case body 501 as illustrated in FIGS. 12 and 13 (wherein the outer surface of the bottom case body is not in view in the drawings) and is described in greater detail below. In this and other embodiments, the stop tab 521, or a tamper-evidency mechanism can provide identification of tampering by a user. For example, in an assembled configuration as illustrated, e.g., in FIGS. 12 and 13, the tray member 515 is locked between top (530) and bottom (501) case bodies. The stop tab 521 extends through the wall defined by abutting wall members 534 and 506 and, with a tamper-evidency mechanism in place through the aperture 541, the tray cannot be removed without removing or modifying the tamper-evidency mechanism or stop tab in some way. Thus, a user can visually identify if the tray has been removed from the case (defined by the top and bottom case bodies in confronting relationship as illustrated e.g., in FIG. 12), which may be evidence of tampering, by inspecting the stop tab and/or tamper-evidency mechanism.

In one exemplary embodiment, a tamper-evidency mechanism includes a length of material, such the aforedescribed plastic strip 576 having adhesive on one side that can be adhered to a portion of the bottom case body 530, fed through the stop-tab aperture 541, and adhered to a portion of the top case body 501 after the dispenser has been assembled with medication therein, e.g., as illustrated in FIGS. 12 and 13. Such a configuration permits identification of tampering, as removing the tray member 515 from the case would tear or otherwise deform the plastic tape 576. In one embodiment, the tamper-evidency mechanism, e.g., the plastic tape 576 can include written indica to warn a user that the contents of the tray member 515 may have been tampered with if the tamper-evidency mechanism is deformed, broken, or otherwise not intact. In this example, the tamper-evidency mechanism includes the warning "Do not use if seal is broken." (See, e.g., FIGS. 12 and 13.)

Figure 19:
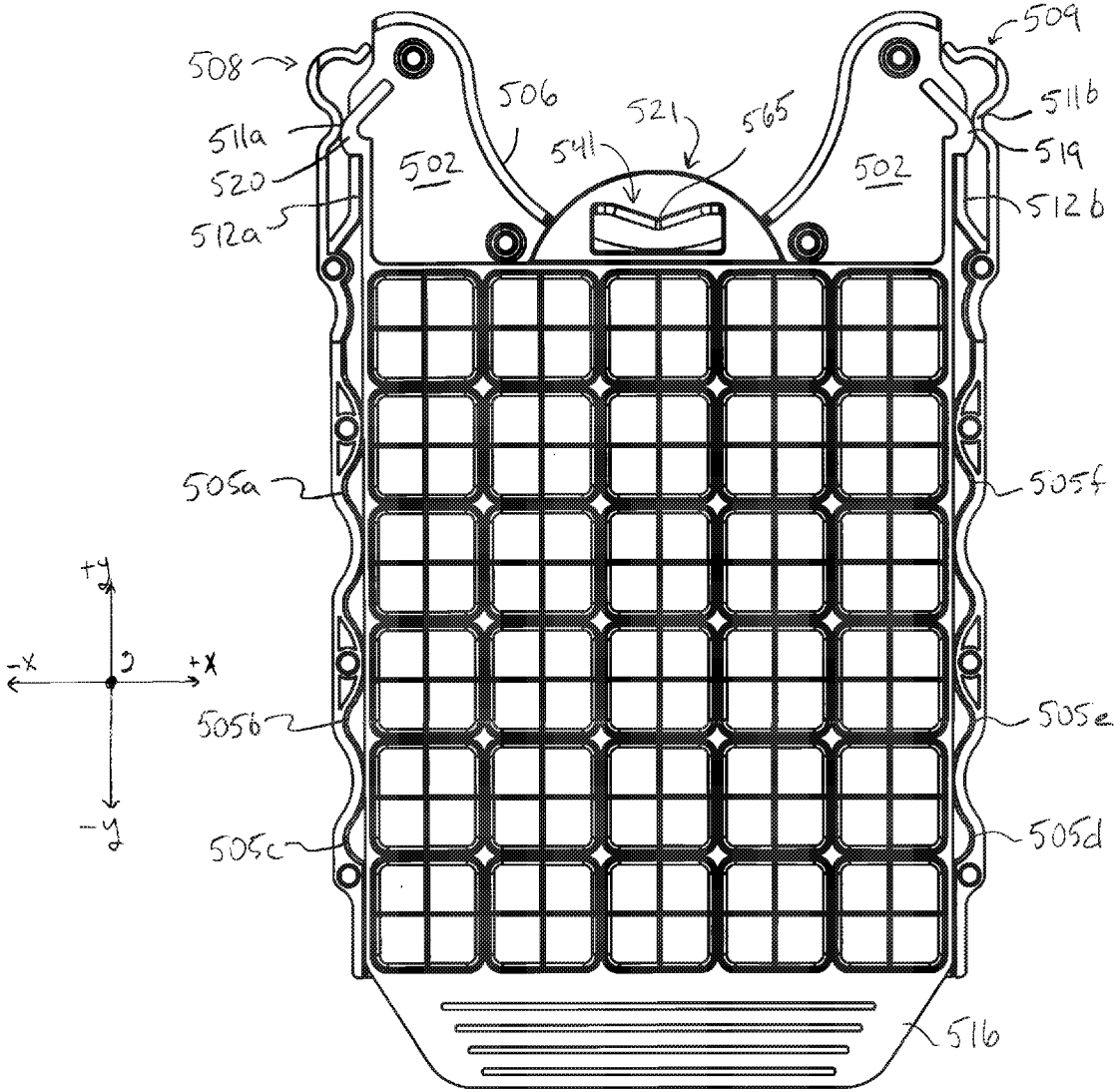
FIG. 19 shows a top-down view of the tray member of FIG. 18 resting within the bottom case body shown in FIG. 14.

In one embodiment, the aperture 541 on the stop-tab 521 can be substantially "M" shaped as illustrated particularly in FIG. 19. In this embodiment, a piercing point 565 of the aperture 541 formed in the stop tab 521 can assist in piercing the tamper-evidency mechanism so that the intended user of the dispenser can remove the tray member 515 from the case without substantial resistance from the tamper-evidency mechanism. It will be understood that other tamper-evidency mechanisms can be used as alternatives, or enhancements to the aforedescribed. For example, strings, wires, plates, seals, or other materials can be positioned within the aperture 541 of the stop tab 521, so that the material will provide evidence if the tray member 515 is removed from the case (i.e., top and bottom case bodies joined as illustrated in, e.g., FIG. 12) without intent or authorization by someone other than the intended user.

In this and other embodiments, resilient adhesives can be used to join the top and bottom case bodies in an assembled dispenser configuration, e.g., as illustrated in FIG. 12, to reduce the likelihood of a person separating the two components to gain access medications within the tray member 515 directly. Similarly, in one embodiment, tamper-evident tapes or other types of seals can be applied about the periphery of the dispenser 500, e.g., on or near the seam where top and bottom case bodies confront in an assembled dispenser configuration to provide visual identification of possible tampering.

In this and other embodiments, the dispenser 500 can be child-resistive with respect to the contents of the tray member 515 and concurrently tamper evident as described above. To remove the tray member 515 from the dispenser, the flexible locking arms 517, 518 can be shifted away from each respective stop arm 512*a*, 512*b*, respectively, such that the engagement surfaces 520, 519 are shifted out of the stop aperture defined by the distal end of each stop arm and the front wall member 506. A user can then grasp the tab member 516 and pull the tray member rearwardly (in the −y direction) to remove the tray member from the case.

In this and other embodiments, the flexible arms 517, 518 can be formed of chosen materials and be configured to have a desired flexibility such that a certain amount of strength is required to shift them away from the stop arms. In a preferred embodiment, the amount of strength is greater than that of an average child. Similarly, in this embodiment, inspection of FIG. 19 in particular illustrates that both flexible locking arms must be shifted toward one another to be able to release the tray member from the case. Thus, in this and other embodiments, child resistance to the contents of the tray can be accomplished by virtue of the amount of strength and dexterity required to shift the flexible locking arms away from the stop arms and simultaneously pull the tab member 516 to remove the tray from the case. In this and other embodiments, the amount of strength and dexterity required to operate the dispenser can be selected to be greater than that normally possessed by a child.

In one non-limiting example, the dispenser 500 can be assembled into a child-resistive, tamper-evident medication dispenser, e.g., by a pharmacist, as follows.

First, the assembler can lay the bottom case body 501 on a surface with the hollow post members 510*a*-510*d* facing up, as illustrated, e.g., in FIG. 14. Next, the assembler can lay the tray member 515 within the bottom case body 501 such that the stop tab 521 fits within the notch 507 of the front wall 506 of the bottom case body 501. Next, the assembler can fill the array of medication receptacles with medication, e.g., a troche medication. In an alternative approach, the assembler can fill the tray member 515 with medications first, then place the tray member within the bottom case body. Next, the assembler can place the top case body 530 over the tray member 515, in an orientation such that the post members, e.g., post members 535*a*-535*d* will fit within the complementary hollow post members 510*a*-510*d* of the bottom case body. Next, the assembler can apply joining pressure suitable to bring the top case body and bottom case body into a substantially confronting relationship, e.g., between side wall members 504 and 532, side wall members 503 and 533, front wall members 506 and 534, etc. Next, the assembler can apply a tamper-evident tape, seal, or locking mechanism to the stop tab 521; disturbance or modification of the tape, seal, or locking mechanism from its state as prepared by the assembler can provide an indication to the user that the contents of the tray member may have been tampered with. Next, the assembler can, optionally, apply a tamper-evident seal around the periphery of the dispenser, e.g., along the seam where side wall and front wall members of top and bottom case bodies are in confronting relationship.

In general, and applicable to any embodiment described herein, including alternative embodiments thereof, methods are provided for supplying a user with a medication substantially contained in a child-proof and tamper evident dispenser.

In one embodiment, a method includes providing a top case member and a bottom case member, e.g., top member 105 and bottom case member 110 as previously described. The method further includes providing a tray member, e.g., tray member 115 as previously described. In the instant method, the tray member 115 can be configured to receive medicines, pharmaceutical compounds, and other similar substances. In one embodiment, the method further includes placing the medicine, pharmaceutical compound, or other similar substance in a receptacle of the tray and lockingly encasing the tray member 115 between the top case member 105 and the bottom case member 110, e.g., as described herein, so as to provide a child-proof and tamper evident dispenser, such as dispenser 100 as described herein.

In one embodiment, continuing with the above examples, a method for dispensing pharmaceutical compounds includes placing a pharmaceutical compound within one or more receptacles 119 of the tray member 115 as described. In the case of troches, the pharmaceutical compound may be suspended or dissolved in a liquid or semi-liquid form as it is dispensed in the receptacle 119. The method further includes encasing the tray member 115 in a case, e.g., case 101 of the dispenser 100 described herein. In one example, the method can include placing the tray member 115 within the bottom case body 110 (having the pharmaceutical compound placed therein with the compartment array 121) so that the neck member 127 confronts the shelf 157 of the bottom case body 110. Next, the top case body 105 can be aligned with the bottom case body 110 so that the locking tab/recess systems 137, 138, 139, 140 are aligned for locking engagement as generally described herein. Next, the top case body 105 can be brought into a confronting relationship with the bottom case body 110, e.g., by pressing the top case body 105 and the bottom case body 110 together; doing so can cause the locking tab/recess systems 137, 138, 139, 140 to lockingly engage, thereby locking the top case body 105 and bottom case body 110 together to enclose the tray member 115 within the case 101.

In various embodiments, a medication or pharmaceutical compound within an assembled dispenser 100 can be accessed as follows. First, the user can grasp the case 101 with a first hand. With a second hand, the user can grasp the stop-tap 125 and twist until the neck portion 127 breaks. The stop-tab 125 can then be discarded. Next, the user can simultaneously pinch the flexible arms 191*a*, 191*b* so as to urge the elbow portions 156*a*, 156*b* of the flexible locking arms 131*a*, 131*b* out of the recesses 170*a*, 170*b* of the case 101. At the same time, the user can grasp the tab member 117 and pull in a direction to slidingly remove the tray member 115 from the case 101.

In this and other embodiments, the tray member 115 can be re-inserted into the case 101. Because the flexible locking arms 131*a*, 131*b* are resiliently flexible, the elbow portions 156*a*, 156*b* may be urged into locking engagement with the case apertures 170*a*, 170*b* to minimize the likelihood that a child or other non-authorized person can access the contents of the compartment array 121.

In certain embodiments, a tamper-evident seal can be disposed along the seam between confronting portions of the top case body 105 and the bottom case body 110, so that it may become apparent if the case bodies have been separated after being mated, e.g., in a configuration for retail sale or dispensing by a physician or pharmacist.

A number of illustrative embodiments have been described. Nevertheless, it will be understood that various modifications may be made without departing from the spirit and scope of the various embodiments presented herein. For example, dispensers of the type described herein, including alternative forms and variations, can be made of any material suitable for an intended application. Such materials can be selected, e.g., under consideration of manufacturing cost, availability of materials, weight, resilience, structural rigidity, or other factors. Dispensers of the type described herein can be fabricated according to chosen dimensions and are not limited to the illustrations presented in the figures. In general, dispensers of the type described herein can include indica for various purposes. For example, a case, e.g., case 101 can include markings, warning labels, directions for use of pharmaceuticals contained therein, contact information of pharmacists, doctors, or other health care providers, and other indica. Furthermore, in some embodiments, dispensers can include components for computer-aided cataloging, storage, or dispensing. For example, dispensers can include bar codes, radio-frequency identifiers (RFID's) or other similar components used by doctors, hospitals, pharmacies, and the like. In some embodiments, the tray member 115 can be flexible so as to assist the user in removing tablets or troches contained therein. In some embodiments, the compartment array 121 can include labels to indicate when a pharmaceutical compound contained in the various receptacles 119 should be administered. For example, each receptacle in the compartment array 121 can be numbered from 1 to 31, corresponding to the days of a month; alternatively, the receptacles can be labeled with the days of the week, or any other preferred form. Accordingly, other embodiments are within the scope of the following claims.

What is claimed is:

1. A medication dispenser, comprising:

a tray member, comprising one or more receptacles for receiving said medication;

a stop tab extending from a first peripheral edge of said tray member for providing tamper evidency of said dispenser; and a tab member connected to a second peripheral edge of said tray member that is opposite from said first peripheral edge; and a bottom case body and a top case body that are configured to lockingly enclose said one or more receptacles of said tray member when brought into a substantially confronting relationship, thereby defining an assembled dispenser configuration, wherein each of said bottom and top case bodies comprise a floor member, a side-wall member, and a front wall member wherein each of the side-wall member and the front wall member are orientated substantially perpendicular to said floor member;

wherein said front wall member of said bottom case body comprises a shelf portion that cooperatively forms a stop-aperture for surrounding a portion of said stop tab substantially proximal to said first peripheral edge of said tray member when said top and said bottom case bodies are in said assembled dispenser configuration;

wherein, when said top and said bottom case bodies are in said assembled dispenser configuration, said side-wall members cooperatively form opposite peripheral dispenser walls having at least one engagement aperture therein for receiving an engagement surface of a resiliently flexible locking arm disposed on said tray member, and a portion of a substantially rectangular aperture disposed opposite of said front wall member from which said tray member can be extracted from said dispenser.

2. The medication dispenser of claim 1, wherein when said top and said bottom case bodies are in said assembled dispenser configuration, said side-wall members form opposite peripheral dispenser walls having oppositely disposed engagement apertures therein, each for receiving an engagement surface of oppositely-disposed, resiliently flexible locking arms on said tray member, respectively.

3. The medication dispenser of claim 1, wherein said stop tab is configured to extend beyond said front wall member and provide evidence if said tray member is removed from said dispenser in said assembled dispenser configuration.

4. The medication dispenser of claim 3, wherein said stop tab comprises an aperture for receiving a removable locking mechanism therethrough in a stop tab portion that extends beyond said front wall member.

5. The medication dispenser of claim 4, wherein said locking mechanism is a wire, string, tie, zip-tie, or lock-tie.

6. The medication dispenser of claim 1, wherein said stop-aperture has a width dimension, said stop tab has a width dimension greater than said stop-aperture width dimension, and said stop tab further comprises a neck member connected to said first peripheral edge of said tray member, wherein a width dimension of said neck member is less than said width of said stop tab, and wherein said stop tab is capable of being removed from said tray member by breaking said neck member.

7. The medication dispenser of claim 6, wherein said stop tab is configured to abut said front wall member about said stop-aperture if said tray member is shifted toward said substantially rectangular aperture while said neck member is unbroken.

8. The medication dispenser of claim 1, wherein said stop tab is configured to be modified by a user to allow said tray member to be slidably removed from said dispenser in said assembled dispenser configuration.

9. The medication dispenser of claim 1, wherein said resiliently flexible locking arm is normally biased so as to urge said engagement surface into said engagement aperture.

10. The medication dispenser of claim 1, wherein said front wall member is C-shaped.

11. The medication dispenser of claim 1, wherein at least one of said bottom case body or said top case body further comprises a resiliently flexible arm that is shiftable to reversibly engage a portion of said resiliently flexible locking arm, to provide the capability of urging said engagement surface away from said engagement aperture.

12. The medication dispenser of claim 1, wherein said side-wall members have a substantially corrugated cross-section comprising one or more recesses configured to receive said engagement surface of said resiliently flexible locking arm for incrementally slidingly removing said tray member from said dispenser in said assembled dispenser configuration.

13. The medication dispenser of claim 12, wherein said side walls are configured to receive fingers of the human hand.

14. The medication dispenser of claim 1, wherein said tray member can be reversibly slidingly disengaged from between said bottom case body and said top case body.

15. The medication dispenser of claim 1, wherein said bottom case body comprises a coupling member extending substantially orthogonal to said floor member, and said top case body comprises a complimentary coupling recess for receiving said coupling member in a substantially locked configuration to join said bottom case body and said top case body in said assembled dispenser configuration.

16. The medication dispenser of claim 15, wherein said coupling member is a configured as a lock tab.

17. The medication dispenser of claim 1, wherein said one or more receptacles for receiving said medication are configured as a troche tray.

18. The medication dispenser of claim 1, wherein tamper evidency of said dispenser is provided by a perceptible physical state of said stop tab, and child-proofing said medication within said tray member is provided by configuring said resiliently flexible locking arm to require a requisite amount of strength and dexterity greater than that normally possessed by an average child to disengage said engagement surface of said resiliently flexible locking arm from said engagement aperture when said dispenser is in said assembled dispenser configuration to remove said tray member from said dispenser.

19. The medication dispenser of claim 1, wherein said tray member comprises two of said flexible locking arms; wherein said wall members are configured to provide two engagement apertures, each for receiving one of said engagement surface from one of said flexible locking arms, respectively; and wherein said extraction of said tray member from said dispenser through said substantially rectangular aperture requires both of said engagement surfaces to be shifted out of each respective engagement aperture substantially simultaneously.

20. A method for providing a child-proof and tamper-evident medication dispenser, comprising:

providing a tray member, comprising:

one or more receptacles for receiving said medication;

a stop tab extending from a first peripheral edge of said tray member for providing tamper evidency of said dispenser; and a tab member connected to a second peripheral edge of said tray member that is opposite from said first peripheral edge; and providing a bottom case body and a top case body that are configured to lockingly enclose said one or more receptacles of said tray member when brought into a substantially confronting relationship, thereby defining an assembled dispenser configuration, wherein each of said bottom and top case bodies comprise a floor member, a side-wall member, and a front wall member wherein each of the side-wall member and the front wall member are orientated substantially perpendicular to said floor member;

wherein said front wall member of said bottom case body comprises a shelf portion that cooperatively forms a stop-aperture for surrounding a portion of said stop tab substantially proximal to said first peripheral edge of said tray member when said top and said bottom case bodies are in said assembled dispenser configuration;

wherein, when said top and said bottom case bodies are in said assembled dispenser configuration, said side-wall members cooperatively form opposite peripheral dispenser walls having at least one engagement aperture therein for receiving an engagement portion of a resiliently flexible locking arm disposed on said tray member, and a substantially rectangular aperture is formed opposite of said front wall member from which said tray member can be extracted from said dispenser; and wherein tamper evidency of said dispenser is provided by a perceptible physical state of said stop tab, and child-proofing medication within said tray member is provided by configuring said resiliently flexible locking arm to require an amount of requisite strength and dexterity greater than that possessed by an average child to disengage said engagement portion of said resiliently flexible locking arm from said engagement aperture when said dispenser is in said assembled dispenser configuration to remove said tray member from said dispenser.

* * * * *